US006462720B1

(12) United States Patent
Yamashita et al.

(10) Patent No.: US 6,462,720 B1
(45) Date of Patent: Oct. 8, 2002

(54) LIGHT-EMITTING DISPLAY DEVICE, TARGET GAME APPARATUS USING LIGHT-EMITTING DISPLAY DEVICE, DISPLAY SWITCHING METHOD AND TARGET HIT DISPLAY METHOD

(75) Inventors: Akihisa Yamashita; Kojiro Minami; Hirofumi Fujimoto; Katsunori Hirasawa; Masatoshi Mukai; Yutaka Tsuji, all of Kobe (JP)

(73) Assignee: Konami Co. Ltd., Hyogo (JP)

( * ) Notice: Subject to any disclaimer, the term of this patent is extended or adjusted under 35 U.S.C. 154(b) by 0 days.

(21) Appl. No.: 09/440,390

(22) Filed: Nov. 15, 1999

(30) Foreign Application Priority Data

Nov. 18, 1998 (JP) ..... 10-328691

(51) Int. Cl.[7] ..... G09G 5/00
(52) U.S. Cl. ..... 345/4; 345/44; 273/348
(58) Field of Search ..... 345/4, 5, 9, 43, 345/44, 82; 273/348, 371–374, 376, 378, 379; 362/559, 560

(56) References Cited

U.S. PATENT DOCUMENTS 4,333,657 A * 6/1982 Jaworski et al. ..... 273/376
4,695,059 A * 9/1987 Yamashita et al. ..... 273/371
5,328,190 A * 7/1994 Dart et al. ..... 273/371

FOREIGN PATENT DOCUMENTS

JP 5010175 2/1975
JP 448581 4/1992
JP 655098 4/1992
JP 568592 9/1993
JP 09173632 7/1998
JP 10230081 9/1998
JP 10244070 9/1998
JP 10258179 9/1998
JP 10-319248 * 12/1998

* cited by examiner

*Primary Examiner*—Regina Liang
(74) *Attorney, Agent, or Firm*—Bachman & LaPointe, P.C.

(57) ABSTRACT

There is provided a light-emitting display device which is resistive to shock and vibration and a display switching method comprising: a forward transparent plate 322*a* having a light scattering portion for a predetermined design pattern relative to a surface direction thereof, a backward transparent plate 322*b* having a light scattering portion for a predetermined design pattern relative to a surface direction in which the second-mentioned design pattern is different from the first-mentioned design pattern of the light scattering portion of the forward transparent plate, a light source 324 for the forward transparent plate for supplying incidence of light into the forward transparent plate from an end surface of the forward transparent plate, and an other light source 325 for the backward transparent plate for supplying incidence of light into the backward transparent plate from an end surface of the backward transparent plate, so that switching is made from and to emitting and quenching of the backward transparent plate. At the time of luminescence (emitting), the design pattern of the backward panel is synthesized and deleted at the time of quenching.

48 Claims, 13 Drawing Sheets

LIGHT-EMITTING DISPLAY DEVICE, TARGET GAME APPARATUS USING LIGHT-EMITTING DISPLAY DEVICE, DISPLAY SWITCHING METHOD AND TARGET HIT DISPLAY METHOD

BACKGROUND OF THE INVENTION

1. Field of Art

This invention relates to a structure of a display device for switching a display content without using a display by a matrix array of a luminescent picture element, a display switching method, a structure of a target game apparatus using the display device as an airframe, and a target hit display method.

2. Related Art

Heretofore, there has been known a method of changing a display content, in which a luminescent picture element is placed into a matrix array to switching emission/quenching per a picture element, as a TV screen or a Liquid Crystal Display screen, changing brightness of luminescence, forming a predetermined pattern as an aggregate of a picture element and changing the pattern. Besides, as a display method which does not use a display by a matrix array of a luminescent picture element, there is a known method, as a dial display for a timepiece, for rotatably fixing, at one side portion, a plurality of plates having figures or numbers printed on both surfaces thereof so that the plates can be opened sequentially as opening pages of a book. There is another method of feeding a belt-like sheet on which display content is printed thereon from one side to the other, like a destination display panel for a shuttle bus.

The former method in which a matrix array of luminescent picture element is used requires a high technique for picture element array and apparently needs much larger number of picture elements, with the indispensable result of a high cost. Further, since it requires an extremely high Integration of circuit, it inevitably becomes fragile against vibration, shock, etc. The latter method which does not has a matrix array of luminescent picture element has mechanical movement portions and, therefore, results in large-sizing and generation of failure.

SUMMARY OF THE INVENTION

It is, there fore , a n object of the present invention to solve the problems inherent to the known methods and devices and to provide a display device of and method for changing a display content which has properties that it is inexpensive and of a compact structure as well as vibration and shock resistance and t o provide a target game apparatus utilizing the properties of the display device described above and a target hit display method for displaying hitting of a target.

In order to meet with the requirements of achieving the objects of the present invention, according to one aspect of the present invention as recited in claim 1, there is provided a light-emitting display device comprising: a forward transparent plate having a light scattering portion for a predetermined pattern relative to a surface direction thereof, a backward transparent plate having a light scattering portion for a pattern relative to a surface direction thereof and disposed at the back of the forward transparent plate in the surface direction of the forward transparent plate, the pattern of the light scattering portion of the backward transparent plate being different from the pattern of the light scattering portion of the forward transparent plate, a light source for the forward transparent plate for supplying incidence of light into the forward transparent plate from an end surface of the forward transparent plate, a light source for the backward transparent plate for supplying incidence of light into the backward transparent plate from an end surface of the backward transparent plate, and switching means for switching emitting/quenching of the light source for the backward transparent plate. In the structure described above, by simply switching the light source of the backward transparent plate from a quenching state to an emitting state, a display seen from a forward direction of the forward transparent plate can be immediately switched from a pattern of a light scattering portion of the forward transparent plate to a display of a synthesized pattern of the pattern in the light scattering portion of the forward transparent plate and the pattern in the light scattering portion of the backward transparent plate. In addition, the structure is relatively simply and has no mechanical portion of operation and, therefore, the structure is of shock/vibration-resistive so that an inexpensive device can be achieved with less failure. It should be noted that as well as switching from quenching of the light source for the backward transparent plate to emitting of the light source, the light source of the forward transparent plate can be switched from emission to quenching so that a design on the light scattering portion of the forward transparent plate can be displayed in a relatively weak (or tender) manner. The light scattering portion can be formed by selectively applying a coating material on the transparent plate, roughening the transparent surface by using a file and the like, or adapting or fitting another material into the transparent plate, or employing any other suitable methods.

In another aspect of the invention, at least one of the light scattering portion of the forward transparent plate and the light scattering portion of the backward transparent plate is formed by applying a coating material on a surface of the transparent plate. This permits provision of a desired light-emitting display device which can be switched simply and inexpensively.

In another aspect of the invention, a photo-adsorption member is disposed at the back of the backward transparent plate. This can prevent or restrict light scattering at the other portions than the pattern portion, which light scattering is caused by flaws on the forward and backward transparent plates, foreign particles, transparency of the material per se and so forth, so that the necessary pattern can be emerged to aid recognizing the display.

In another aspect of the invention, there is provided a light-emitting display device in which a translucent is provided between the forward transparent plate and the backward transparent plate. This will prevent the pattern of the backward transparent plate from being visible or reconized at the time of quenching of the light source of the backward transparent plate so that the pattern of the forward transparent plate is emerged to aid seeing soley and seperately the display of the forward transparent plate.

In another aspect of the invention, the pattern of the light scattering portion of the backward transparent plate is a cracking pattern. This permits to provide a fancy impression as if the both transparent plates are cracked, at the time when the backward transparent plate is switched from a quenching state to an emmitting (luminescent) state.

In a further aspect of the invention, a shock sensor is disposed for detecting a shock against the forward transparent plate so that when a shock is detected by the shock sensor, the light source for the backward transparent plate is switched from a quenching state to an emitting state. This will permit dramatic display of the posture of a change due to the shock received by the display portion.

In another aspect of the invention, a plurality of backward transparent plates are provided relative to the forward transparent plate and the switching means designed to serve to switch the light source of a corresponding backward transparent plate from a quenching state to an emitting state with respect to a shock-impacted portion of the forward transparent plate. This permits to provide an international and dramatic display representing a posture of a change in response to the shock received by the display portion and additionally displaying a location of the portion which receives the shock.

In another aspect of the invention, a plurality of forward transparent plates are provided and a backward transparent plate is provided corresponding to each of the forward transparent plates and the switching means is designed to serve the light source for the backward transparent plate which corresponds to the forward transparent plate receiving the shock to switch from a quenching states to an emitting state. This structure can restrict to transmit a shock received by one of the forward transparent plates to other forward transparent plate and, therefore, permits to clearly indicate a portion in the display portion that has received the shock.

In another aspect of the invention, the shock sensor is disposed at the back of the corresponding forward transparent plate so that a shock transmitted from the forward transparent plate is detected. This apparently does not obstruct the figure or design of the forward transparent plate and, therefore, permits to enhance seeing the display. Further, a shock from a front surface of the forward transparent plate can easily be detected.

In another aspect of the invention, a contact sensor is further provided for detecting a contact of an object to a front surface of the forward transparent plate so that switching of emitting/quenching of the light source for the backward transparent plate is controlled in response to an output of the contact sensor. This structure permits to control switching of display in response to the contact of the object to the forward transparent plate.

In another aspect of the invention, the object sensor is a shading type sensor so that a portion adjacent to the front surface of the forward transparent plate serves as at least a part of an optical path. This permits a reliable detection of a contact of an object to a portion in the forward transparent plate.

In another aspect of the invention, at least one of the light incident end surfaces of the forward transparent plate and the light incident end surfaces of the backward transparent plate is positioned in a staggered fashion relative to an adjacent end surface of the other transparent plate. This structure can prevent the light, which has leaked or escaped from the incident into the corresponding transparent plate of the light source for the transparent plate, from incoming to the other transparent plate from an end surface of the other adjacent transparent plate, so that switching of the display can be made more distinctively.

In another aspect of the invention, the end surface for the incident of light of the forward transparent plate is staggered, inside the backward transparent plate, relative to the end surface adjacent to the corresponding backward transparent plate. By this structure, leaked light from the incident into the backward transparent plate of the light source for the forward transparent plate is reliably prevented from incoming into the corresponding backward transparent plate and, therefore, figure or design of the backward transparent plate is prevented from being displayed at an unnecessary time.

In another aspect of the invention, there is provided a target game apparatus in which a competition is made to hit a target of an airframe by forcing the airframe to fly toward the target plate to evaluate result of the targeted position, comprising a light-emitting display device as the target, wherein the light-emitting display device comprises: a forward transparent plate having light scattering portion of a predetermined pattern relative to a surface direction thereof, a backward transparent plate having a light scattering portion for a pattern relative to a surface direction thereof and disposed at the back of the forward transparent plate in the surface direction of the forward transparent plate, the pattern of the light scattering portion of the backward transparent plate being different from the pattern of the light scattering portion of the forward transparent plate, a light source for the forward transparent plate for providing incidence of light into the forward transparent plate from an end surface of the forward transparent plate, a light source for the backward transparent plate for providing a light incidence into the backward transparent plate from an end surface for the backward transparent plate, and switching means for switching emitting/quenching of the light source of the backward transparent plate. By the target game apparatus described above, by simply switching the light source of the backward transparent plate from a quenching state to an emitting state, a display seen from a forward direction of the forward transparent plate can be immediately switched from a pattern of a light scattering portion of the forward transparent plate to a display of a synthesized (composed) pattern of the pattern in the light scattering portion of the forward transparent plate and the pattern in the light scattering portion of the backward transparent plate. In addition, the structure is relatively simple and has no mechanical portion of operation and, therefore, the structure is of shock/vibration-resistive so that an inexpensive device can be achieved with less failure in spite of repeated collision of the airframe.

In a further aspect of the invention, at least one of the light scattering portion of the forward transparent plate and the light scattering portion of the backward transparent plate is formed by applying a coating material on a surface of the transparent plate. This structure permits provision of a further inexpensive target game apparatus which can be produced simply and inexpensively.

In another aspect of the invention, a photo-adsorption member is disposed at the back of the backward transparent plate. This can prevent or restrict light scattering at the other portions than the pattern portion, which light scattering is caused by flaws on the forward and backward transparent plates, foreign particles, transparency of the material per se and so forth, so that the necessary pattern can be emerged to aid recognizing the display.

In another aspect of the invention, a translucent plate is provided between the forward transparent plate and the backward transparent plate. This will prevent the pattern of the backward transparent plate from being visible or recognized at the time of quenching of the light source of the backward transparent plate so that the pattern of the forward transparent plate is emerged to aid seeing solely and separately the display of the forward transparent plate.

In another aspect of the invention, the pattern of the light scattering portion of the backward transparent plate is a cracking pattern or design. This permits to provide a fancy impression as if the both transparent plates are cracked, at the time when the backward transparent plate is switched from a quenching state to an emitting (luminescent) state.

In a further aspect of the invention, a shock sensor is provided for detecting a shock against the forward transparent plate so that when a shock is detected by the shock sensor, the light source of the backward transparent plate is switched from a quenching state to an emitting state. This will permit dramatic display of the posture of a change due to the shock received by the display portion.

In another aspect of the invention, a plurality of backward transparent plates are provided relative to the forward transparent plate and the switching means is desired to serve to switch the light source of a corresponding backward transparent plate from a quenching state to an emitting state with respect to a shock-impacted portion of the forward transparent plate. This permits to provide an intentional and dramatic display representing a posture of the change in response to the shock received by the display portion and additionally displaying a location of the portion which receives the shock.

In another aspect of the invention, a plurality of forward transparent plates are provided and a backward transparent plate is provided according to each of the forward transparent plates and the switching means is designed to serve the light source of the backward transparent plate which corresponds to the forward transparent plate receiving the shock to switch from a quenching state to an emitting state. This structure can restrict to transmit a shock received by one of the forward transparent plates to other forward transparent plate and, therefore, permits to clearly indicate a portion in the display portion that has received the shock.

In another aspect of the invention, the shock sensor is disposed at the back of the corresponding forward transparent plate so that a shock transmitted from the forward transparent plate is detected. This apparently does not obstruct the figure or design of the forward transparent plate and, therefore, permits to enhance seeing the display. Further, a shock from a front surface of the forward transparent plate can easily be detected.

In another aspect of the invention, a contact sensor is further provided for detecting a contact of an object to a front surface of the forward transparent plate so that switching of emitting/quenching of the light source for backward transparent plate is controlled in response to an output of the contact sensor. This structure permits to control switching of display in response to the contact of the object to the forward transparent plate.

In another aspect of the invention, the object sensor is a shading type sensor so that a portion adjacent to the front surface of the forward transparent plate serves as at least a part of an optical path. This permits a reliable detection of an accurate contact against the target of the flyframe.

In another aspect of the invention, at least one of the light incident end surfaces of the forward transparent plate and the light incident end surfaces of the backward transparent plate is positioned in a staggered relation relative to an adjacent end surface of the other transparent plate. This structure can prevent the light, which has leaked or escaped from the incident into the corresponding transparent plate of the light source for the transparent plate, from incoming to the other transparent plate from an end surface of the other adjacent transparent plate, so that switching of the target display can be made more distinctively.

In another aspect of the invention, the end surface for the incident of light of the forward transparent plate is disposed inside the backward transparent plate relative to the adjacent end surface of the corresponding backward transparent plate. By this structure, leaked or escaped light from the incident into the forward transparent plate for the light source for the forward transparent plate is more reliably prevented from incoming into the corresponding backward transparent plate so that undesired, phantom-like appearing of the display of untargeted indication can reliably be prevented.

In another aspect of the invention, there is provided a display switching method which uses: a forward transparent plate having a light scattering portion for a predetermined pattern relative to a surface direction thereof, a backward transparent plate having a light scattering portion for a pattern relative to a surface direction thereof and disposed at the back of the forward transparent plate in the surface direction of the forward transparent plate, the pattern of the light scattering portion of the backward transparent plate being different from the pattern of the light scattering portion of the forward transparent plate, a light source for the forward transparent plate for supplying incidence of light into the forward transparent plate from an end surface of the forward transparent plate, a light source for the backward transparent plate for supplying an incidence of light into the backward transparent plate from an end surface of the backward transparent plate, and switching means for switching emitting/quenching of the light source of the backward transparent plate, wherein emitting/quenching of the light source for the backward transparent plate is switched to thereby change the display on the forward transparent plate seen from the front position of the forward transparent plate. By the structure described above, the display seen from the front of the forward transparent panel can be immediately changed from the pattern of the light scattering portion of the forward transparent plate to a composite or synthetic display of the pattern of the light scattering portion of the forward transparent plate and the pattern of the light scattering portion of the backward transparent plate. Further, it can be formed into simplified structure without a mechanical structure for operation, and the operation can be achieved by this inexpensive, less-faulty and shock-resistive display device. It is also possible to switch the light source for the forward transparent plate from an emitting state to a quenching state to thereby permit weakening of the display of the pattern of the light scattering portion of the forward transparent plate. The light scattering portion can be formed by selectively applying a coating material on the transparent plate, roughening the transparent surface by using a file and the like, or adapting or fitting another material into the transparent plate, or employing any other suitable methods.

In another aspect of the invention, there is provided a target hit display method in which target hitting of an airframe is displayed intentionally, wherein the method uses: a forward transparent plate having a light scattering portion for a predetermined pattern relative to a surface direction thereof, a backward transparent plate having a light scattering portion for a pattern relative to a surface direction thereof and disposed at the back of the forward transparent plate in the surface direction of the forward transparent plate, the pattern of the light scattering portion of the backward transparent plate being different from the pattern of the light scattering portion of the forward transparent plate, a light source for the forward transparent plate for supplying incidence of light into the forward transparent plate from an end surface of the forward transparent plate, a light source for the backward transparent plate for supplying incidence of light into the backward transparent plate from an end surface of the backward transparent plate, switching means for switching emitting/quenching of the light source for the backward transparent plate, and a shock sensor for detecting a shock to the forward transparent plate, wherein when the shock sensor detects a shock, the switching means switches the light source of the backward transparent plate from a quenching state to an emitting state to thereby permit an intentional display with respect to target hitting of an airframe. This permits an intentional display with respect to target hitting of an airframe.

In another aspect of the invention, there is provided a target hit display method in which target hitting of an airframe is displayed intentionally, wherein the method uses: a forward transparent plate having a light scattering portion for a predetermined pattern relative to a surface direction thereof, a backward transparent plate having a light scattering portion for a pattern relative to a surface direction thereof and disposed at the back of the forward transparent plate in the surface direction of the forward transparent plate, the pattern of the light scattering portion of the backward transparent plate being different from the pattern of the light scattering portion of the forward transparent plate, a light source for the forward transparent plate for supplying incidence of light into the forward transparent plate from an end surface of the forward transparent plate, a light source for the backward transparent plate for supplying incidence of light into the backward transparent plate from an end surface of the backward transparent parent, switching means for switching emitting/quenching of the light source for the backward transparent plate, and an object contact sensor for detecting a contact with the forward transparent plate, wherein when the object contact sensor detects a shock to the forward transparent plate, the switching means switches the light source of the backward transparent plate from a quenching state to an emitting state to thereby permit an intentional display with respect to target hitting of an airframe. This permits a dramatic or intentional display with respect to target hitting to the airframe.

In a further aspect of the invention, there is provided a target hit display method in which target hitting of an airframe is displayed intentionally, wherein the method uses: a forward transparent plate having a plurality of divided regions each having a light scattering portion of a predetermined pattern relative to a surface direction, a backward transparent plate disposed at the back of the forward transparent plate relative to the surface direction of the forward transparent plate and having a plurality of divided regions divided corresponding to said divided regions of said forward transparent plates and each having a light scattering portion of a pattern which is different from the pattern of the corresponding divided region of the forward transparent plate, a light source for the forward transparent plate for supplying an incident of light to each of the divided regions of the forward transparent plate from an end surface of the forward transparent plate, a plurality of light sources for the backward transparent plate for supplying independently an incident of light to each of the divided regions of the backward transparent plate from an end surface of the backward transparent plate, a switching means for independently switching an emitting state and a quenching state of each of the light sources for the backward transparent plate, and a shading type sensor using a portion adjacent to a boarder of the predetermined regions along the front surface of the forward transparent plate as at least a part of a light path, wherein when the shading type sensor is shaded, the light source for the backward transparent plate corresponding to opposite regions adjacent to the corresponding boarder is switched from a quenching state to an emitting state to thereby intentionally display target hitting of an airframe to both regions. This structure permits a reliable and inexpensive display showing a simultaneous hitting of the plural targets in the regions by a pair of the airframes.

BRIEF DESCRIPTION OF THE DRAWING

FIG. 4(*b*) Is a sectional view taken along D—D in FIG. 2.

DETAILED DESCRIPTION OF THE EMBODIMENTS

Figure 1:
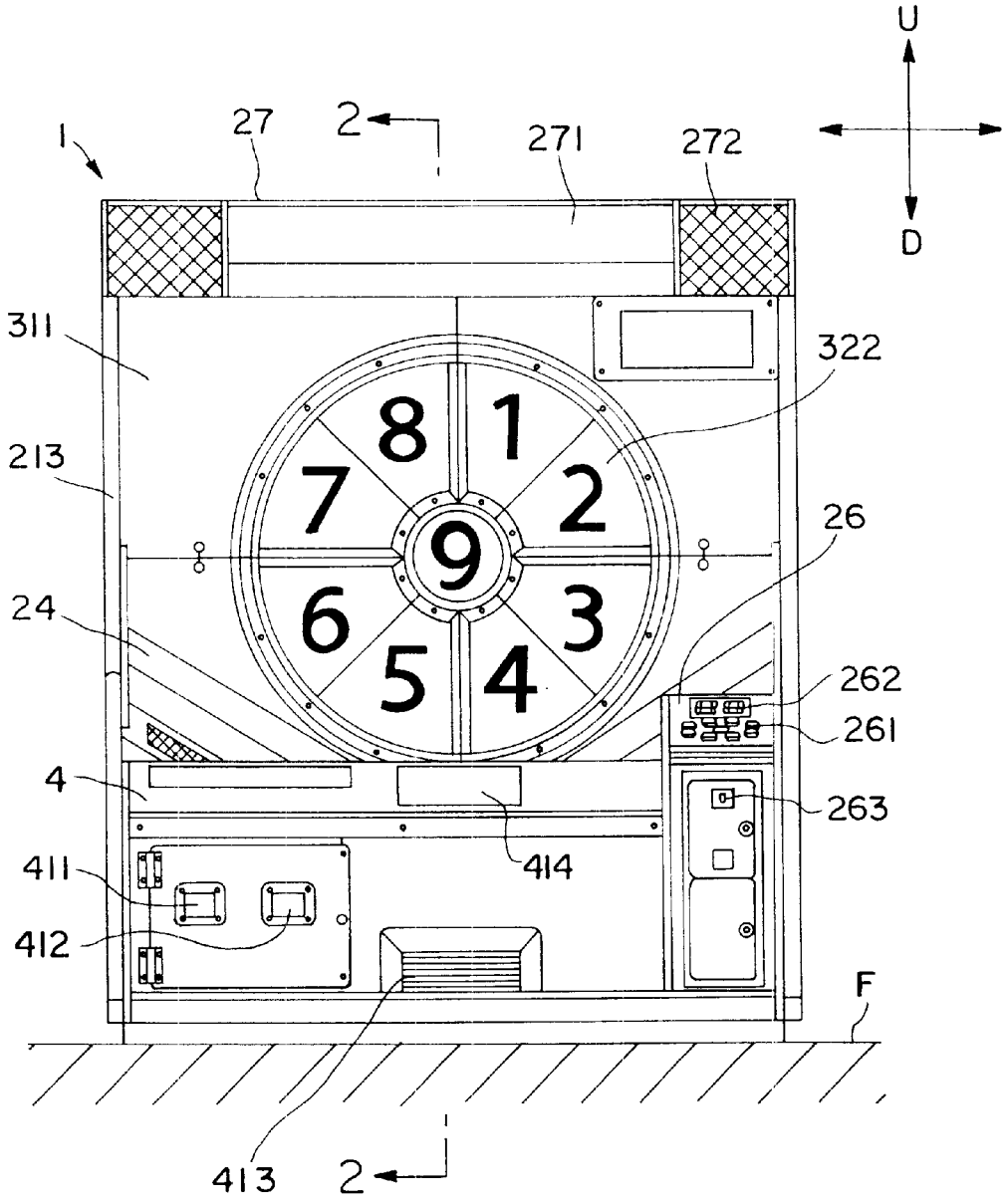
FIG. 1 is a front view of a game device according to an embodiment of the invention.
Figure 2:
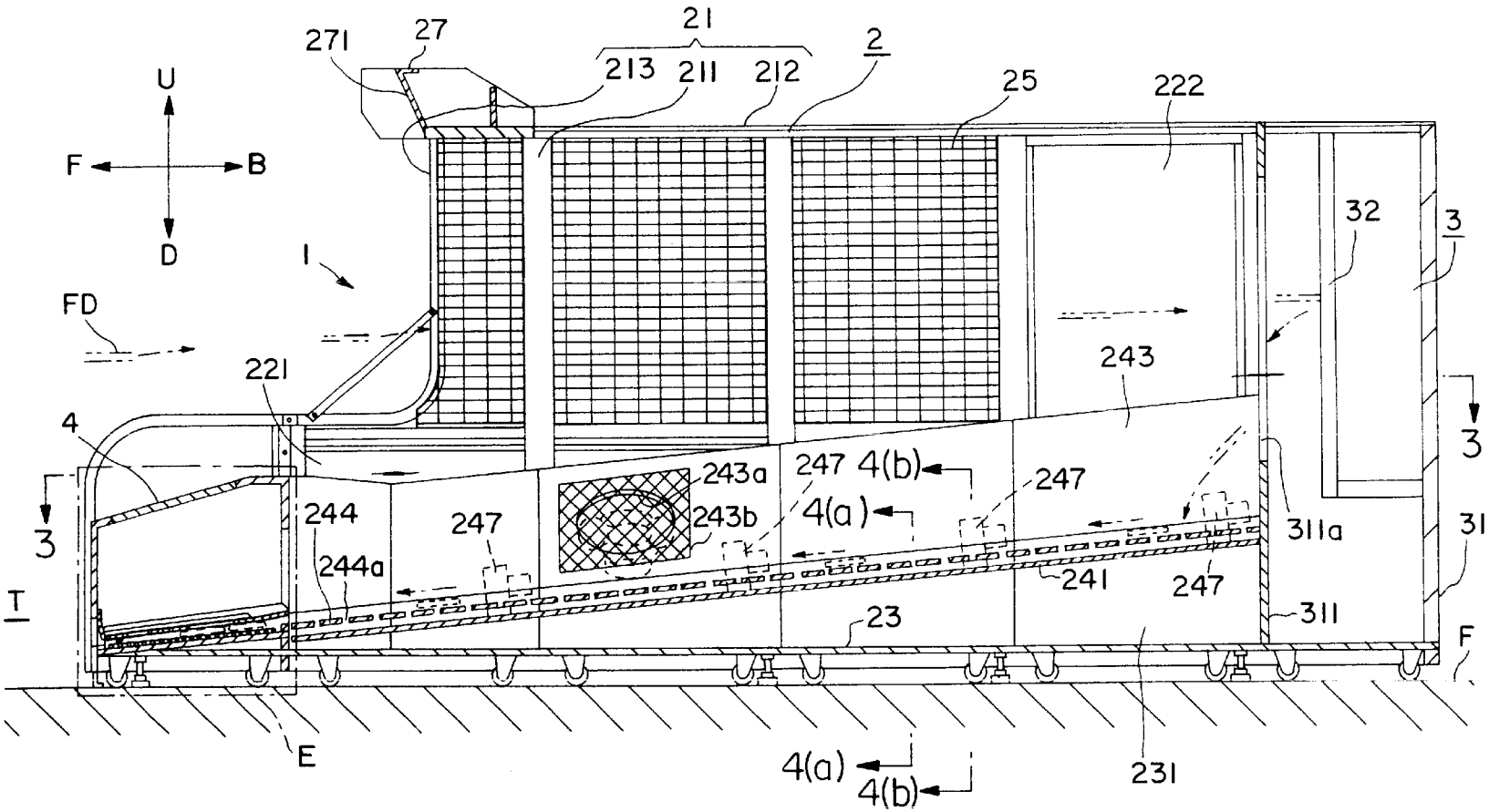
FIG. 2 is a sectional view of the target hit game device taken along A—A in FIG. 1.
Figure 3:
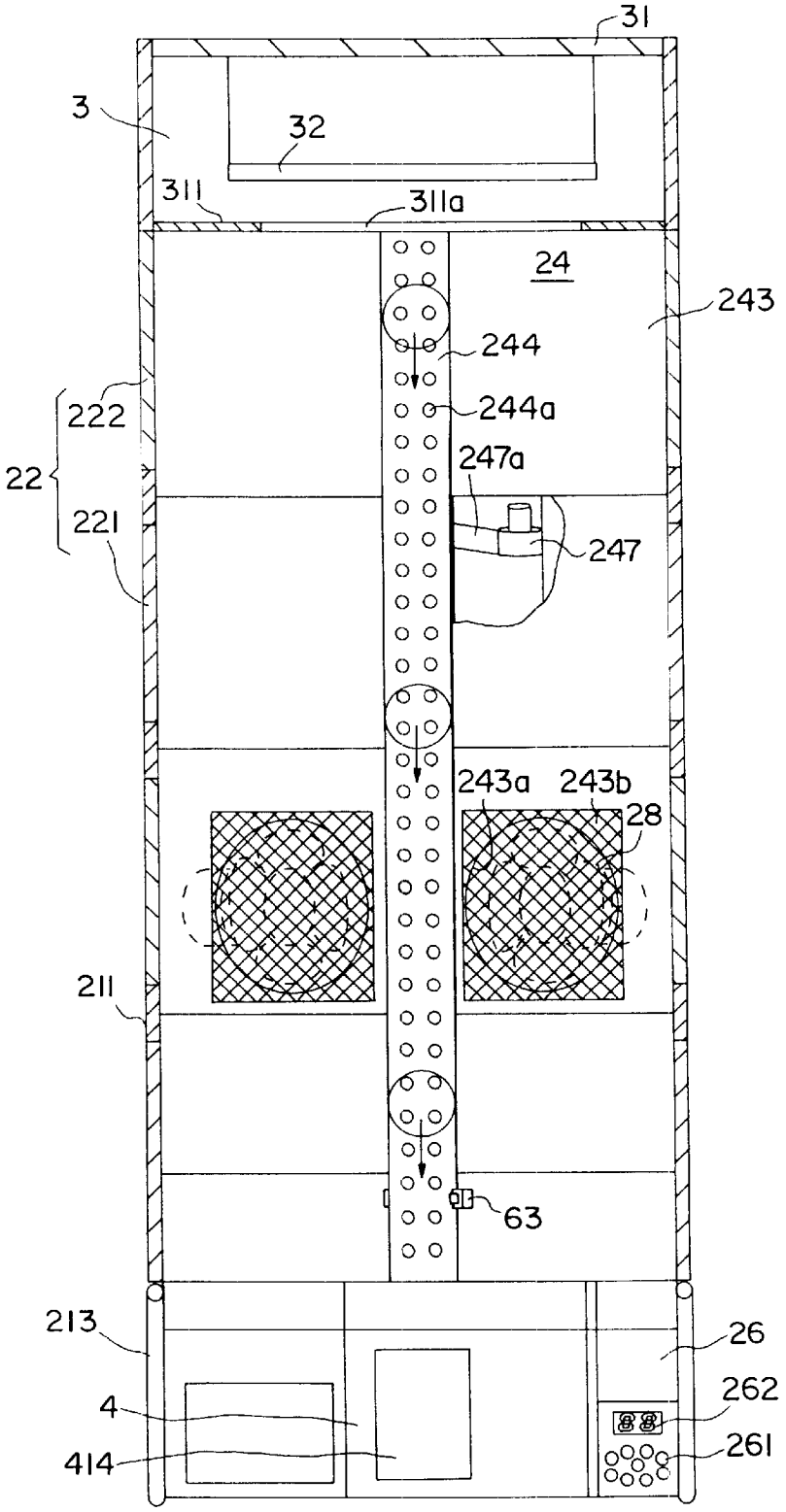
FIG. 3 is a sectional of the target hit game device take along B—B in FIG. 2.

FIG. 1 is a front view of a game device according to an embodiment of the present invention, FIG. 2 is a sectional view of the target hit game device 1 taken along A—A in FIG. 1, and FIG. 3 is a sectional view of the target hit game device 1 taken along B—B in FIG. 2. The target hit game device 1 is installed on a floor F and has forward box 2 and a back box 3.

In FIG. 1, arrows R, L, U and D represent a right side direction, a left side direction, upward direction and downward direction, respectively, of the game device. In FIG. 2, arrows F. B, U and D represent a forward direction, a backward direction, an upward direction and a downward direction, respectively, of the game device 1. Hereinafter, it will be anticipated that each of the directions such as forward, backward, right side, left side, upward and downward directions of each of the elements represents the direction of each of the directions shown in FIGS. 1 and 2.

The forward box 2 has a basic or skeletal structure of a frame structure composed mainly of a vertical frame 211 extending upward and downward, a lateral frame 212 extending in the forward and backward direction and a substantially Z-shaped, folded frame 213.

On each side portion of the left and right side portions of the frame 21, side plates 22 extending upwardly and downwardly are provided. With respect to the side plates 22, in the position from forward to a three-thirds (¾) position in the forward-backward direction, a side plate 221 having a short length in the upward-downward direction is provided to closed only a lower portion from a middle portion in the upward-downward direction of the side portion. In a remaining backward portion of one-fourth (¼), a side plate 222 having an upward-downward length substantially equal to the upward-downward length of the aforementioned side portion, and the place where the longitudinal side plate 222 is disposed is substantially entirely closed in the upward-downward direction.

Between the opposed side plates 22 is provided a bottom plate 23 extending horizontally. On the horizontal bottom plate 23 is provided a supporting plate 231 on which chute 24 is disposed. By the co-action of the side plates 22, the base plate 23 and the chute 24, a basic portion of the forward box 2 is formed.

Between a portion of the frame 21 which is not closed by the side plate 22 and the lateral frame 212 extending the forward-backward direction of the upper portion is provided a net 25 which serves to restrict an oval body which has been thrown out from flying out of the game device 1.

A flying disc supply portion 4 is provided on the forward of the forward box 2. On the front plate of a housing 41 of the flying disc supply portion 4, a print sheet due-out port 411. a memorial medal due-out port 412, and a flying disc take-out port 413. A print sheet bearing thereon results of the target hit game is paid out and, on the other hand, when high marks or points are obtained in a target hit game, a memorial medal is discharged from the print sheet due-out port 412. Further, a flying disc FD (of flat configuration) is paid out one by one from the take-out port 413.

On the right side of the flying disc supply portion 4 is provided a console box 26, which is provided on its upper surface indication buttons 261 for assigning a start of the game. and directing the next target in the game. Besides, on the upper panel of the console box 26, a score indication portion 262 is provided so that when the target panel 322 is hit by the flying disc FD on the panel, scores of marks obtained by the hitting of the target are displayed by light sign on the score indication portion 262. On a forward portion of the console box 26, a coin slot 263 is provided so that coins can be inserted therethrough.

An indication lamp portion 27 is provided adjacent to a front end of the lateral frame 212 extending in the forward-backward direction of an upper portion of the frame 21. On the forward portion of the indication lamp portion 27, a light-transmitting indication panel 271 bearing a name and the like of the game device is provided so that the indication lamp 27 is lit by an electric tube (not shown) housed in the indication lamp portion 27. On both of the right and left sides of the indication panel 271, speakers 272 are provided so that, as the game goes on, various sounds and voices are generated and outputted for stirring up the game interest and atmosphere by the speakers 272.

As shown in FIGS. 2 and 3, the back box 3 has a box-like casing 31 which has a opening panel 311 with a round hole 311 at its center and a target body 32 within the casing 31. The target body 32 is positioned at the back of the opening panel 311, and eight fan-shaped target panels 322 which occupy or form a main portion of the target body 32 and a central, round-shaped target panel 322 are exposed in the forward position through the round hole 311*a*.

As shown by phantom lines in FIG. 2, a player stands at a throwing position T and throws a flying disc FD against the target panel 322. The flying disc FD is then abutted against the target panel 322 and rebounded in the forward direction and dropped on the chute 24.

As described above, the chute 24 is supported by the supporting plate 231 and disposed in the forward box 2. The supporting plate 231 is of trapezoidal shape having an upper surface which is downwardly inclined in the forward direction, and the chute 24 is positioned on the supporting plate 231 in such a manner that it is downwardly inclined from a forward position of the opening panel 311 to the flying disc supply portion 4.

Figure 4A:
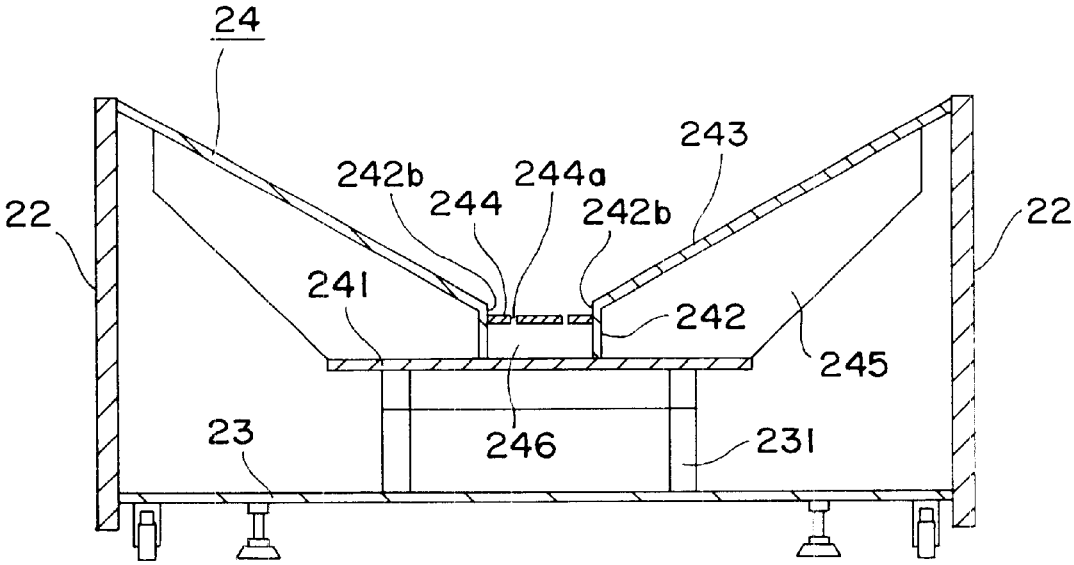
FIG. 4(*a*) is a sectional view taken along C—C in FIG. 2.
Figure 4B:
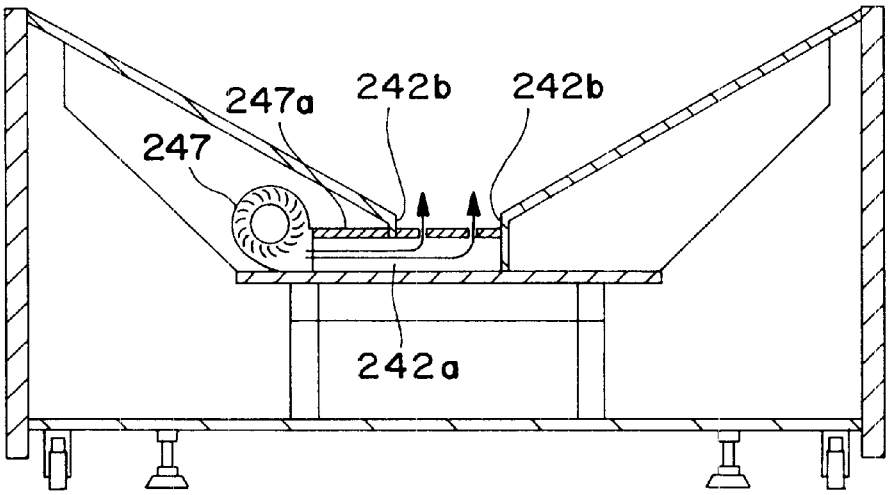

FIG. 4(*a*) is a sectional view taken along C—C in FIG. 2 showing an example of the chute 24, and FIG. 4(*b*) is a sectional view taken along D—D in FIG. 2 showing an example of the chute 24.

As shown in FIG. 4(*a*), the chute 24 has a base plate 241, a pair of upright plates 242 standing in a confronting relation with each other on the base plate 241, a pair of inclined plates 243 (guide members) each downwardly inclined toward an upper end of each of the paired upright plates 242, and a delivery plate 244 interposed between the confronted upright plates 242.

The inclined plates 243 are supported by the supporting plates 245 in a downwardly inclined posture extending toward an upper end of the upright plates 242 from the side plates 22, and a lower end of the inclined plates 243 is connected with the upper end of the upright plates 242. Since a distance from the side plate 22 to the upright plate 242 is relatively short, the flying disc FD which has rebounded forwardly and dropped on the inclined plate 243 is moved or slid by its gravity along the inclined surface of the inclined plate 243 until it drops on the delivery plate 244.

A plurality of air holes 244*a* are formed on the delivery plate 244 in the forward-backward direction thereof, a rectangular, tube-like chamber 246 having a larger length in its forward-backward direction is formed by the delivery plate 244, the paired upright plates 242 and the base plate 241.

On the right side of the chamber 246 on the base plate 241, four blower fans 247 as a air supply means are provided in a spaced relation in the forward-backward direction, and an air exhaust portion 277*a* of the blower fans 247 is connected with an air inlet port 242*a* of the right sided upright plate 242, so that air discharged from the flower fan 247 is received by the air inlet port 242*a* to fill the interior of the chamber 246, and the air is spouted upwardly from the air hole 244*a* of the delivery plate 244 as shown by an arrow shown in FIG. 4(*b*).

The delivery plate 244 is disposed between inner side surfaces of the confronting upright plates 242, at the position slightly lowered from the upper end of the upright plates 242. Thus, the upright walls 242*b* are formed above the upper surface of the delivery plate 244 in the upright plates 242, and, by combination of the upright walls 242*b* and the delivery plate 244, a conduit-like groove 248 having an opening at its upper portion is formed.

A width between the inner side surfaces of the confronting upright plates 242 is slightly larger than a diameter of the flying disc FD and, therefore, the flying disc FD is guided along the upright walls 242*b* of right and left sides and directly moved in the forward direction without any unnecessary movement in the right-left directions and, at this moment, since the flying disc FD is round shaped in a plan view, only a round portion of the flying disc FD is contacted with the upright walls 242*b*, the flying disc FD is successfully guided with a smooth, sliding contact with the upright walls 242*b*.

Figure 5:
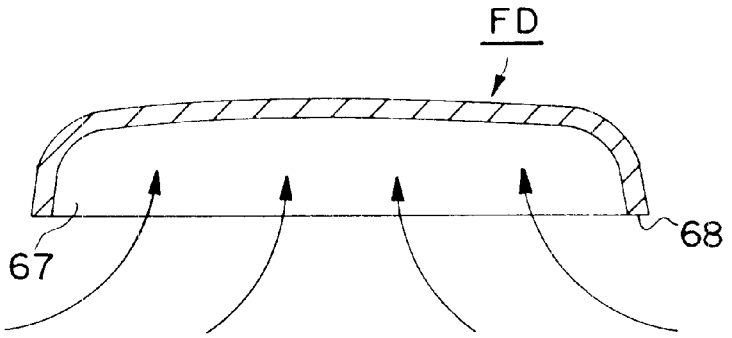
FIG. 5 is a vertical sectional view of a flying disc.

FIG. 5 is a vertically sectional view of the flying disc FD, taken along a vertical line along a diameter of the flying disc.

As shown in FIG. 5, the flying disc FD has a recess 67 on the back. thereof and, air which is spouted from the delivery plate 244 and captured by the recess 67 will facilitate the flying disc FD to rise and fly. Further, a contact portion between the flying disc FD and the delivery plate 244 is limited to an circumferential end 68 of the recess 67 and, therefore, a frictional resistance is decreased substantially to permit a smooth delivery.

On a part nearer to the forward portion of the inclined plate 243, a round hole 243*a* is provided and a mesh plate is provided to cover the round hole 243*a*. Below the round hole 243*a* is provided an air blower 28 which blows an air upwardly. Air blown out by the air blower 28 is fed into the forward box 2 through the mesh plate 243*a* and forms a turbulence flying up in the forward box 2.

Thus, the flying disc FD thrown from the throwing position T against the target is flown by the turbulence generated by the air blower 28 and fly outside the control of a player of the game and, consequently, degree of difficulty in the game is increased in spite that a distance to the target is relatively small and therefore provides a great interest in the game.

Further, on the forward of the groove 248, a recovery sensor 63 as a reflector type photo-sensor is provided to detect the flying disc FD to pass on the delivery plate 244.

Figure 6:
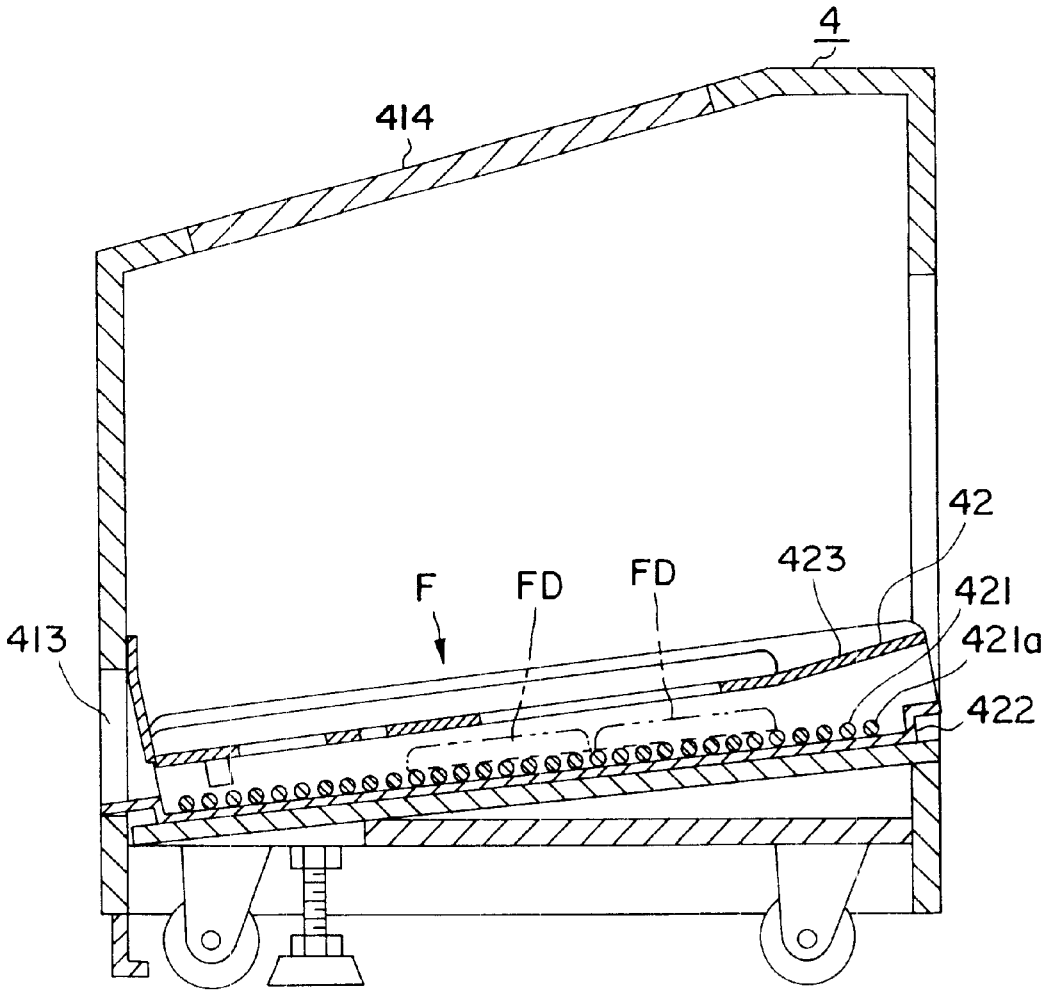
FIG. 6 is an enlarged view of an "E" portion shown in FIG. 2.
Figure 7:
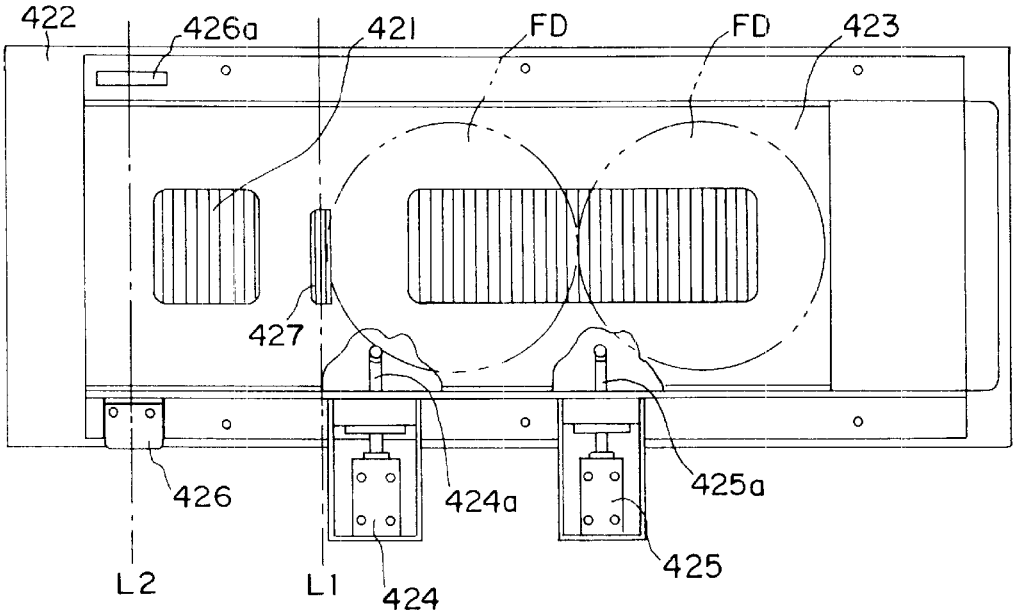
FIG. 7 is a plan view of a disc due-out device viewing from an arrow F direction in FIG. 6.

FIG. 6 is a sectional view showing a flying disc supply portion 4 in an embodiment of the invention and an enlarged view of an "E" portion in FIG. 2. FIG. 7 is a plan view of the flying disc device 42 viewed from the direction of an arrow F in FIG. 6.

As shown in FIG. 6, the flying disc supply portion 4 is composed of a box-like housing 41 and a flying disc due-out (delivery) device 42 in the housing 41. On the forward plate of the housing 41, a flying disc take-out port 413 is provided, and a backward plate which is in an opposed relation with the forward plate is provided with an opening. On the upward plate of the housing 41 is provided a maintenance door 414 for inspecting the flying disc delivery device.

As shown in FIGS. 6 and 7, the flying disc delivery (due-out) device 42 is constructed such that a roller conveyer 421, which has a plurality of rollers 421*a* with an rotational axis extending in the left and right directions, is disposed in a lower case 422, and an upper cover 423 is fixed at a position which permits the flying disc FD to pass on the roller conveyer 421. The upper cover 423 is partly cut out in a rectangular shape, through which the roller conveyer can be visibly recognized.

The lower case 422 is fitted in the housing 42 in a forwardly inclined posture from an opening of the backward plate of the housing 41 to the flying disc take-out port 413, and a rear end of the lower case 422 is connected with a downstream end of the delivery plate 244 and a front end the same is connected with the flying disc take-out port 413.

The flying disc FD delivered in a sliding manner along the delivery plate 244 is fed from the downstream end of the delivery plate 244 to the roller conveyer 421 and stored in the flying disc delivery (due-out) device 42.

On the right side of the lower case 422, a solenoid A424 and a solenoid B424 are provided back and forth.

As shown by phantom lines in FIG. 6, the flying disc FD is held by a rod A424*a* of the solenoid A424 and a rod B424*b* of the solenoid B425 and stored in the flying disc delivery device 4. The flying disc FD serves to drive the solenoids A424 and B425 to change the movement (advance and retraction) of each rod of the solenoids so that the flying discs are delivered one by one to the flying disc take-out port 413.

In other words, in the state shown in FIG. 7, when the solenoid A424 is driven to move in and out the rod A424*a*, the coupling between the rod A424*a* and the flying disc FD is released so that the flying disc FD is delivered on the roller conveyer 421 to the flying disc take-out port 413.

The flying disc FD is detected by a delivery sensor A426 when it is delivered to the flying disc take-out port 413. The delivery sensor A426 is a reflector type photo-sensor in which light emitted from an emitting portion is reflected by a mirror 426A and incident to a optical receptor portion, and serves to detect an optical interception by passing of the flying disc delivered to the flying disc take-out port 413.

When passing of the flying disc FD is detected by the delivery sensor A426, the solenoid B425 is switched ON while the solenoid A424 is switched OFF. Thus, the rod B425*a* of the solenoid B425 is moved in and out and, at the same time, the rod A424*a* of the solenoid A424 is advanced. As a result, the flying disc FD which has bee held by the rod B425*b* of the solenoid B425 is advanced to the position where the it is held by the rod A424*a* of the solenoid A424.

The delivery (due-out) sensor B427 serves to detect existence or presence of the flying disc FD held by the rod A424*a* of the solenoid A424, and recognize, by the detection of the delivery sensor B427, whether or not the flying disc FD is under a stand-by condition. The delivery sensor B427 can be a close-contact type sensor as a photo-sensor or a mechanical switching device as a limit switch.

Figure 8:
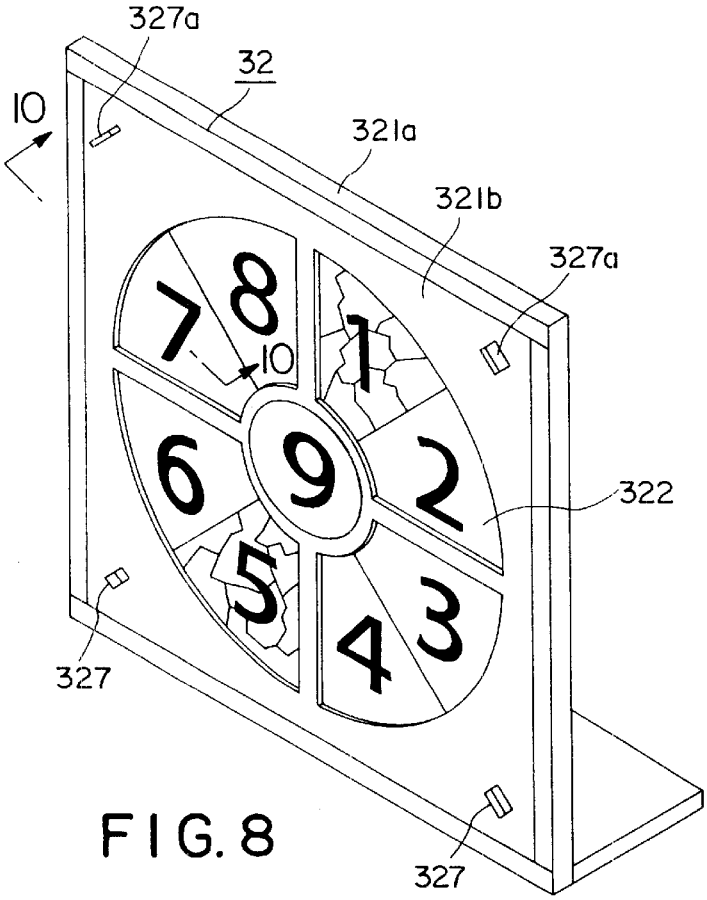
FIG. 8 is a perspective view of an example of a target body according to an embodiment of the invention.

FIG. 8 is a perspective view of the target body 32 in an embodiment of the invention. As shown in FIG. 8, the target body 32 has a target frame 321 composed of a panel body 321*b* having fan-shaped and round cut-out portions on a frame body 321*a* of angle type bars, eight (8) fan-shaped target panels 322 positioned at the fan-shaped cut-out portion on the back of the panel body 321*b*, and a single round shaped target panel 322 positioned at the round shaped cut-out portion on the back of the panel body 321*b*. The both fan-shaped target panels 322 and the round shaped target panel 322 are exposed at their front portions in the forward position through the cut-out portions.

Figure 9:
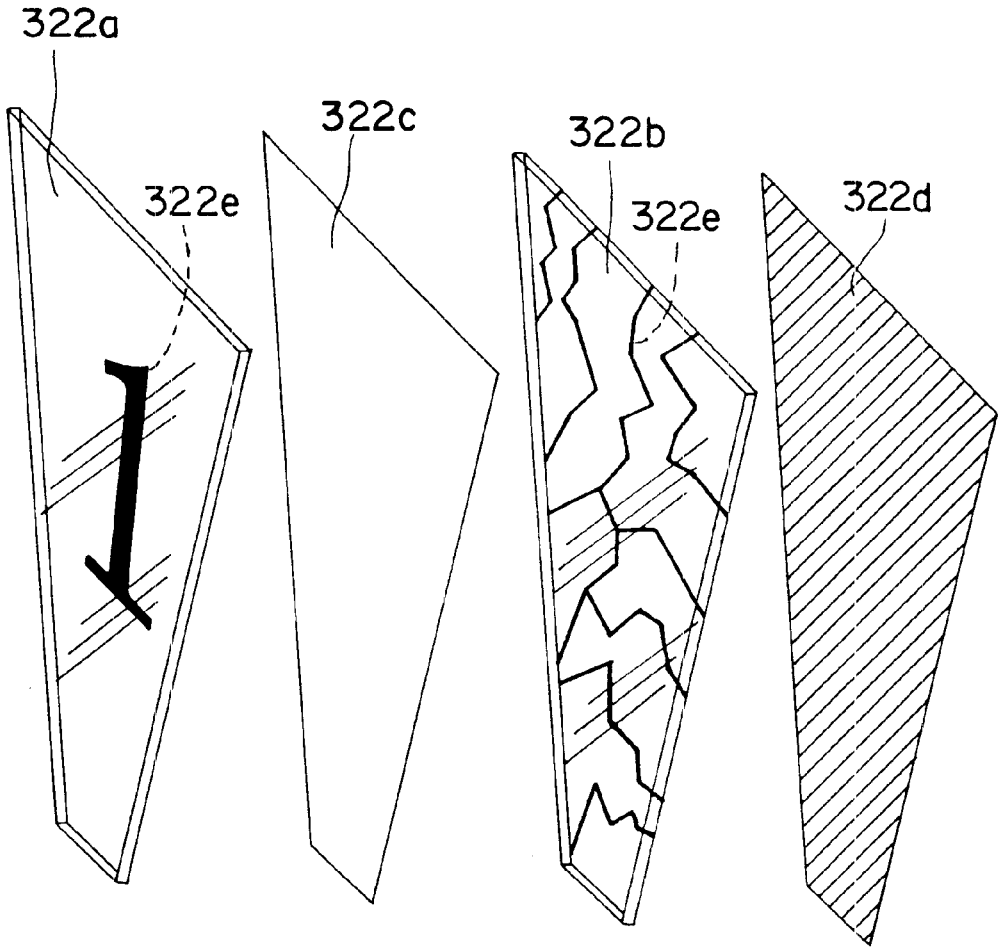
FIG. 9 is a fragmentary perspective view of a target panel, showing the elements for forming the target panel.

FIG. 9 is a fragmentary perspective view of the elements of the target panel 322. As shown in FIG. 9, the target panel 322 has a first panel member 322*a*, a second panel member 322*b*, a middle sheet 322*c* and a back sheet 322*d* which are aligned and laminated in layers to form a layered structure by, from the forward position, the first panel member 322*a*, the middle sheet 322*c*, the second panel member 322*b*, and the back sheet 322*d*, in turn.

The first panel member 322*a* and the second panel member 322*b* are made of transparent synthetic resin material as acrylic resin, and the back surfaces of the first and second panel members 322*a*, 322*b* are provided with display marking 322*e* which has been treated by diffusion treatment by suitable methods such as carving, etching and printing, etc. In the illustrated embodiment of the invention, numerical figures from "1" to "9" are indicated on the back surface of the first panel member 322*a* and a cracking pattern is indicated or printed on the back surface of the second panel member 322*b*.

The middle sheet 322*c* is a light transmitting, translucent sheet such as a tracing paper as a typical example. The purpose of providing the translucent middle sheet 322*c* between the first panel member 322*a* and the second panel member 322*b* is to attempt that the cracking pattern, which is provided on the back surface of the second panel member 322*b*, is not noticeable or visible from the forward position.

The back sheet 322*d* is a black sheet of paper which is provided on the back of the second panel member 322*b* for the purpose of enhancing that the displayed mark 322*c* (figure "1" in case of FIG. 9) on the first panel member 322*a* can be visually recognized in the clearest state when the aforementioned mark is emitted in the color of blue which will be clearly recognized by contrast of the background which is the black sheet.

Figure 10:
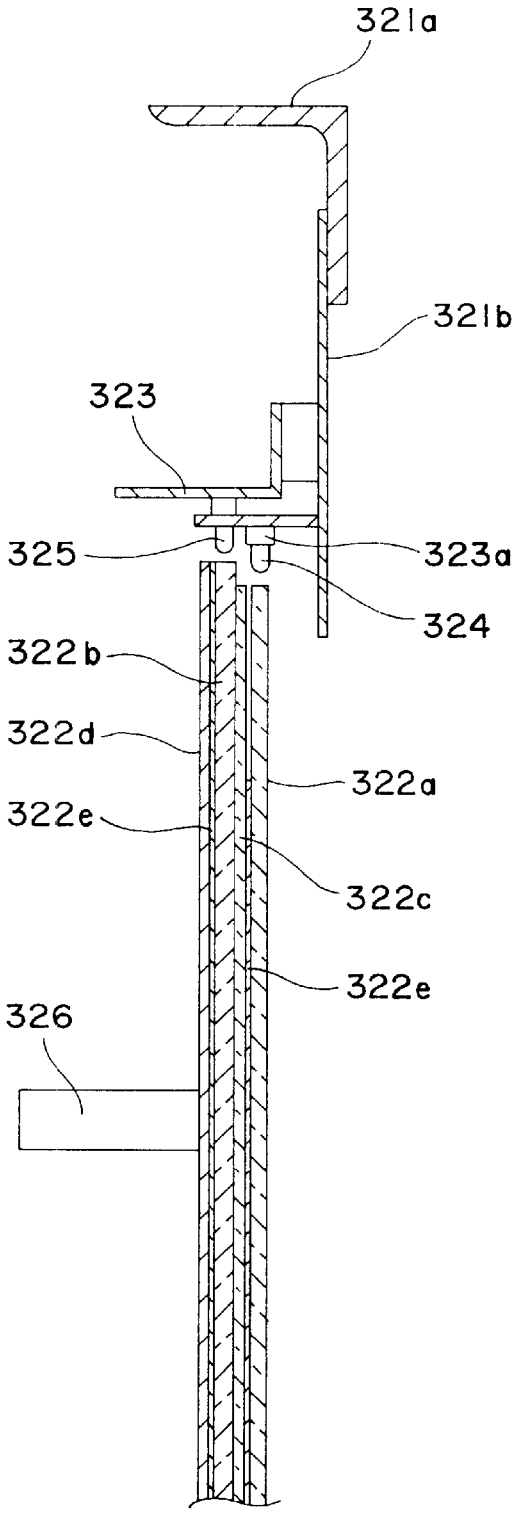
FIG. 10. is a sectional view taken along G—G in FIG. 7.

FIG. 10 is a sectional view of the target body 32, taken along G—G in FIG. 8. On the back surface of the panel body 321*b* of the target frame 321 is fitted a bracket 323, which has LED7A 324 and LED7B 325 of different luminescent colors aligned in rows. The LED7A 324 of a front row is a blue LED having a luminescent color of blue and the LED7A 325 of a back row is a red LED having a luminescent color of red. The LED7A 324 is positioned in a spaced confronting relation with an end of the first panel member 322*a*, and the LED7B 325 is positioned in a spaced confronting relation with an end of the second panel member 322*b*.

In the embodiment of the invention, when the game starts, the blue luminescent LED7A 324 is lit so that a blue light incidents in the first panel member 322*a* from the end of the first panel member 322*a* and the incident light is abutted against the display mark 322*e* which has been treated by diffusion and then scattered to the outer circumference. Thus, seeing from the forward surface which is opposed to the back surface on which the display mark 322*e* is provided, it is visually recognized as if the display mark 322*e* is solely emitting by the effect of the scattered light of the display mark 322*e*. In other words, on the eight fan-shaped target panels 322, the figure "1" to "8" appear and are displayed in blue luminescence and, on the other hand, on the round shape target panel 322 surrounded by the eight fan-shaped target panels 322, the figure "9" appears and is displayed in blue luminescence.

The target panels 322 each has a target sensor 326 on the back surface of the second panel member 322*b*. The target sensor 326 is a shock sensor serving to detect a shock. When a player of the game hits any of the target panels 322 by the flying disc FD, a shock is detected by the target sensor 326 on the target panel 322. By the detected result of the target sensor 326, the LED B 325 on the hit target panel 322 is lit. Thus, red light incidents into the second panel member 322*b* from the end of the second panel member 322*b*, so that the crack pattern of the display mark 322*e* on the second panel member 322*b* is displayed and appears in red luminescence. As a result, seeing from the front or forward surface of the target panel 322, the crack pattern of the red luminescence is recognized visually in an overlapping relation with the figures of blue-luminescence.

Incidentally, the crack pattern appearing in a red luminescence virtually or imaginary indicates that the flying disc FD abuts against the target panel 322 to result in generation of cracks on the target panel 322 and discriminates the targeted or hit (or marked) panel 322 from unmarked panels. Here, in FIG. 8, the target panels of figure "1" and "5" show the state of being hit or marked. In the illustrated embodiment, both the LED 7A 324 and the LED 7B 325 are disposed at the same bracket 323 so that light incidence is obtained from the end surface of the same side portion relative to the first panel member 322*a* and the second panel member 322*b*. However, it is to be anticipated that the LED 7B 325 can be provided to a side portion of the second panel member 322*b* in a different manner from the case of the LED 7A 324 disposed to the first panel member 322*a*, so that light incident can be obtained from the end surface of the different side portions. This will provide the same results and effects.

On the left and right corners at the lower side of the forward surface of the target frame 321, two-piece shot (hit) discriminator sensors 327 of a shading type sensor are provided for discriminating two-piece hitting by one shot as shown in FIG. 8. The two-piece shot discriminator sensors 327 are of reflector type photo-sensors, and mirrors 327*a* for reflecting the light emitted from each of the two-piece shot discriminator sensors 327 are provided at the corner of the left and right portions on the upper side of the diagonal line of the position of the two-piece discriminator sensors 327. Thus, an optical axis of the emitted light from the two-piece shot discriminator sensors 327 passes through a border between the adjacent two fan-shaped target panels 322 with respect to a boarder of the diagonal line of the target frame 321. Namely, if the thrown out flying disc FD hits the border portion described above, the light of the two-piece shot discriminator sensors 327 is shaded and, consequently, it is possible to detect that the adjacent two fan-shaped target panels 322 are hit or marked at the same time.

The first panel member 322*a* is positioned such that its end surface is indented (or stands back) relative to the end surface of the second panel member 322*b*. The LED 7A 324 in an opposed relation with the end surface of the first panel member 322*a* is fitted to the bracket 323 with a spacer 323*a* disposed therebetween, and projected outwardly relative to the LED 7B 325. By this structure, the light emitted from the LED 7A 324 and LED 7B 325 no longer enters from the end surface of the adjacent panel members and, therefore, each display mark 322*e* from the first panel member 322*a* and the second panel member 322*b* can be emitted in a single and pure color without any mixture of colors.

Figure 11:
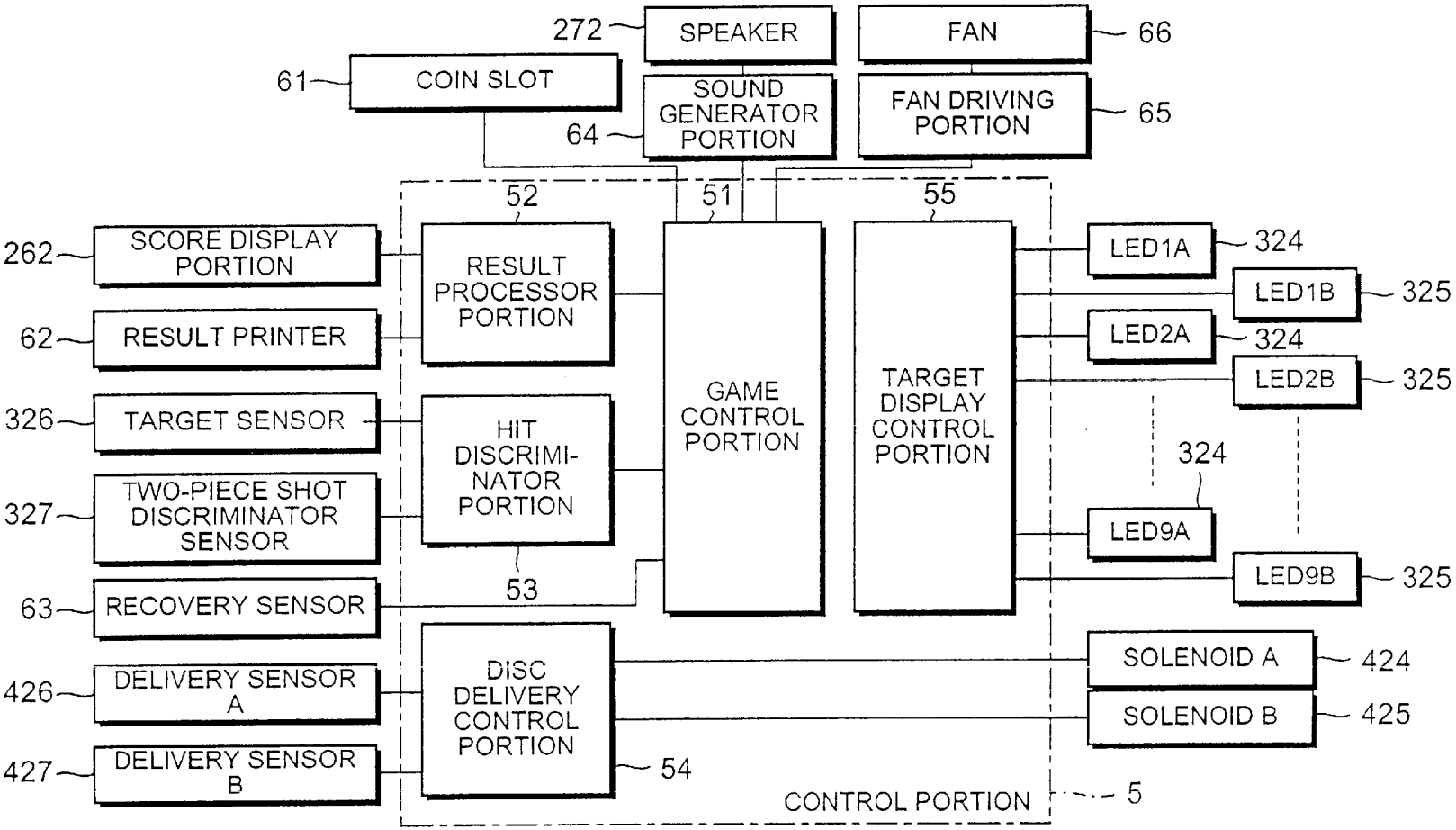
FIG. 11 is a block diagram showing a function of the target hit game device according to the embodiment of the invention.

FIG. 11 is a block diagram showing an operation of the target hit game device according to the embodiment of the invention, which has a control portion 5 and its peripheral devices. The control portion 5 has a game control portion 51, a result processor 52, a hit discriminator portion 53, a disc delivery control portion 54 and a target display control portion 55.

The game control portion 51 serves to control a main flow or process in the entire game of the target hit game device 1 in accordance with signals from the result processor 52, the hit discriminator portion 53, the recovery sensor 63, the disc delivery control portion 54 and a coin insertion slot 61.

The result processor portion 52 calculates the gains or scores by instructions from the game control portion 51 and drives the score display portion 262 to display the scores of the game. Further, by instructions of the game control portion 51 after the game, a result printer 62 is driven to print out the game results.

The hit discriminator portion 53 serves to discriminate which portion of the target is hit and whether or not a two-piece shot is done, by means of the input of the target sensor 326 and the two-piece shot discriminator sensor 327 and then transmits the discriminated information to the game control portion 51.

The disc delivery control portion 54 receives the instruction from the game control portion 51 and drives the solenoid A424 and solenoid B425 in response to the input from the delivery sensors A426 and B425 to thereby conduct delivery of the flying disc FD.

The target display control portion 55 serves to switches on or off the LED 1A 324, . . . , LED 9A 324, LED 1B 325, . . . LED 9B 325 by the instructions from the game control portion 51 and displays the target and a hit (or shot ) of the target.

A fan driving portion 65 drives the blower fan 247 and air blower 28 by the instructions from the game control portion 51 and give a floating power to the flying disc FD to provide variations in flying of the flying disc FD as well as smooth recovery of the flying disc FD.

A sound generator portion 64 serves to output a sound or a voice, which is required case by case according to the process of the game, by instructions from the game control portion 51.

The coin insertion slot 61 transmits a signal to the game control portion 51 when a coin is received by he coin insertion slot 263, and the game control portion 51 starts the game by the signal received by the game control portion 51.

The functions described above can be realized by a sequential circuit using relays and its peripheral circuits and, if desired, a general purpose computer having CPU, memory device, and auxiliary circuits is used to load a predetermined program so that the peripheral circuits are controlled by the computer. In the latter case, the CPU, memory device and auxiliary circuits are coacted with each other in the execution of the program to proceed the functional blocks described above.

An operation of the target hit game in the embodiment of the invention will be described with reference to FIGS. 12 to 15.

Figure 12:
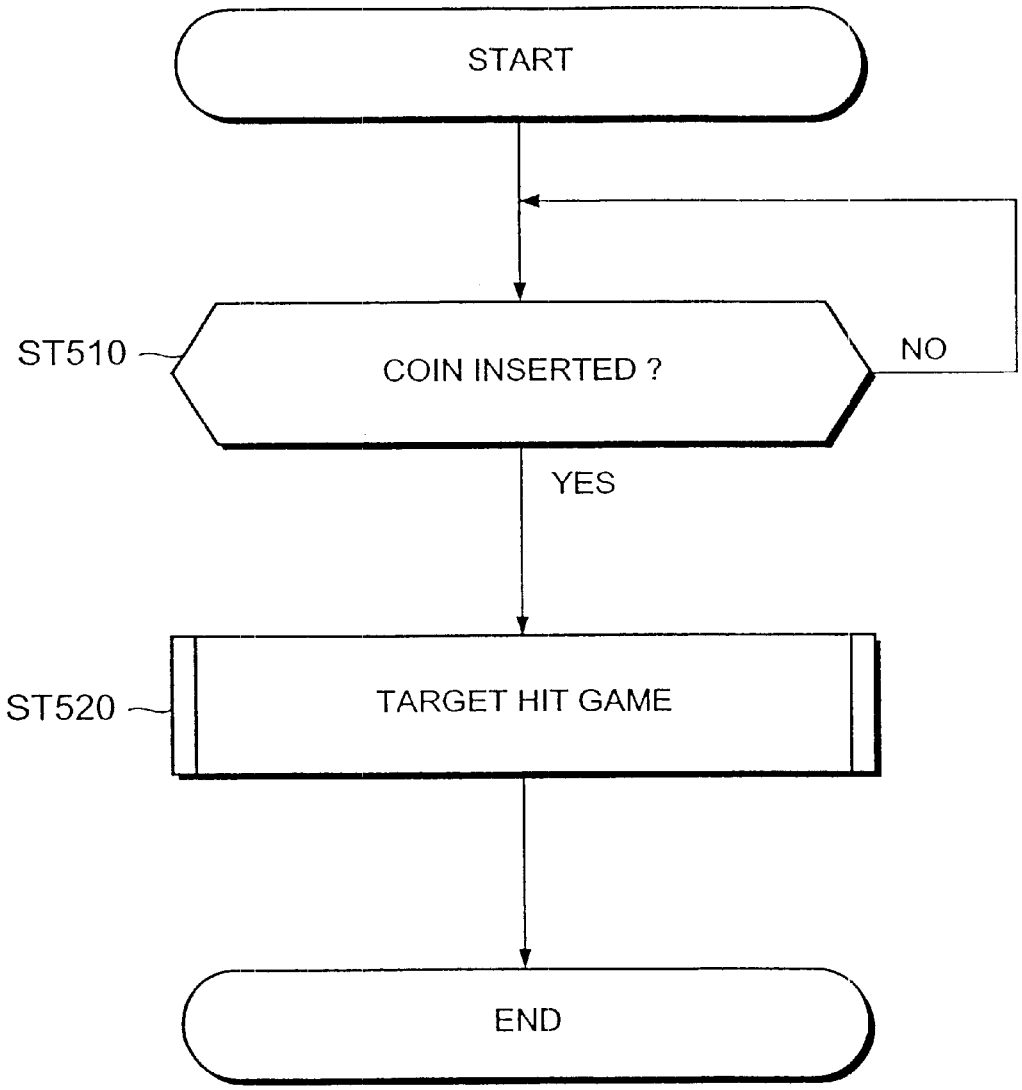
FIG. 12 is a diagram showing a process of a main operation of the target hit game device according to the embodiment of the invention.

FIG. 12 shows a process of a main operation of the target hit game device 1. The game control portion 51 keeps monitoring whether or not there is a coin inserted in the slot 61 (Step ST510), and when coin is found in the slot 61, the process proceeds to step ST520 to thereby start the target hit game.

Figure 13:
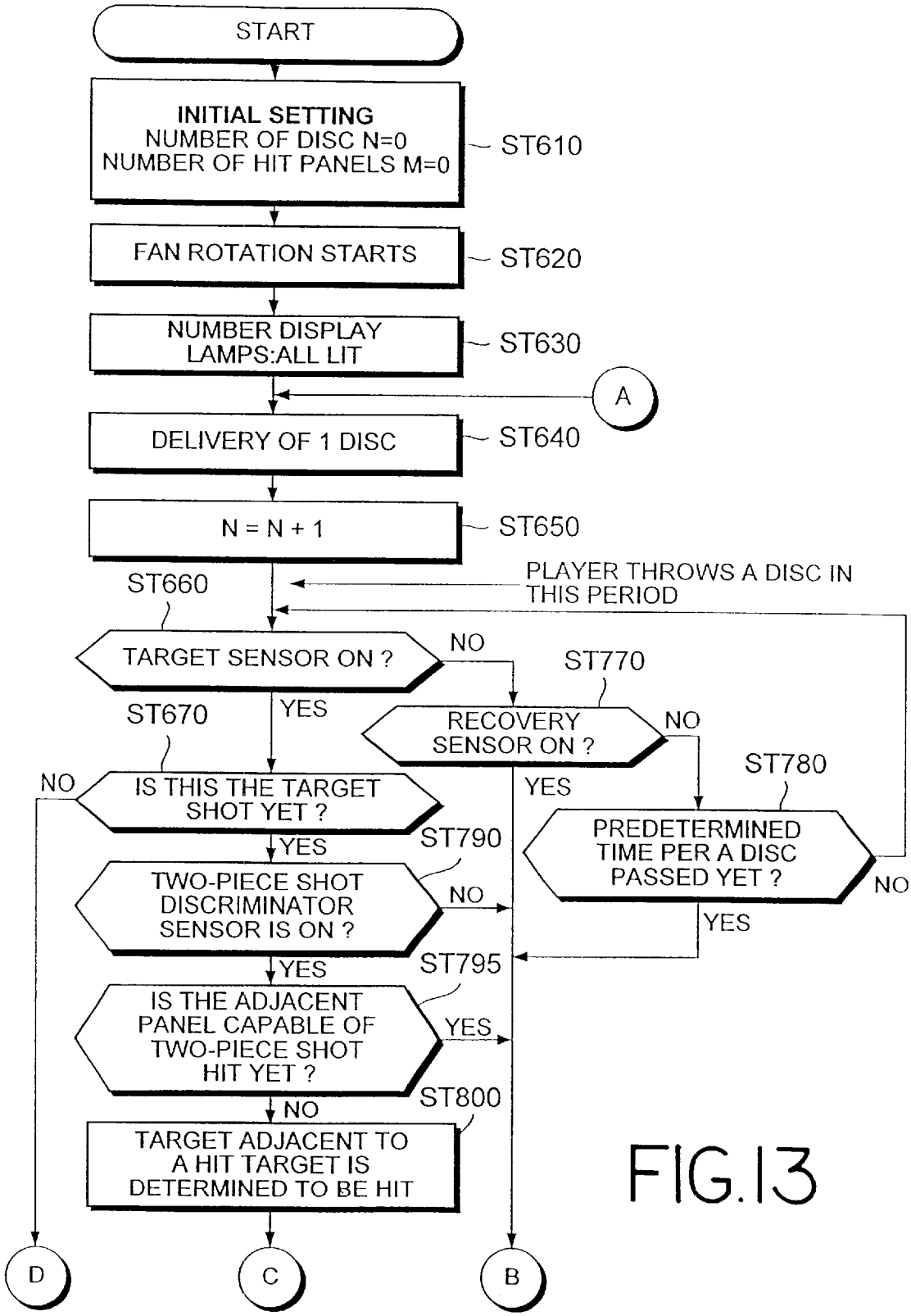
FIG. 13 is a detailed diagram showing a process of a detailed operation of the target hit game device according to the embodiment of the invention.
Figure 14:
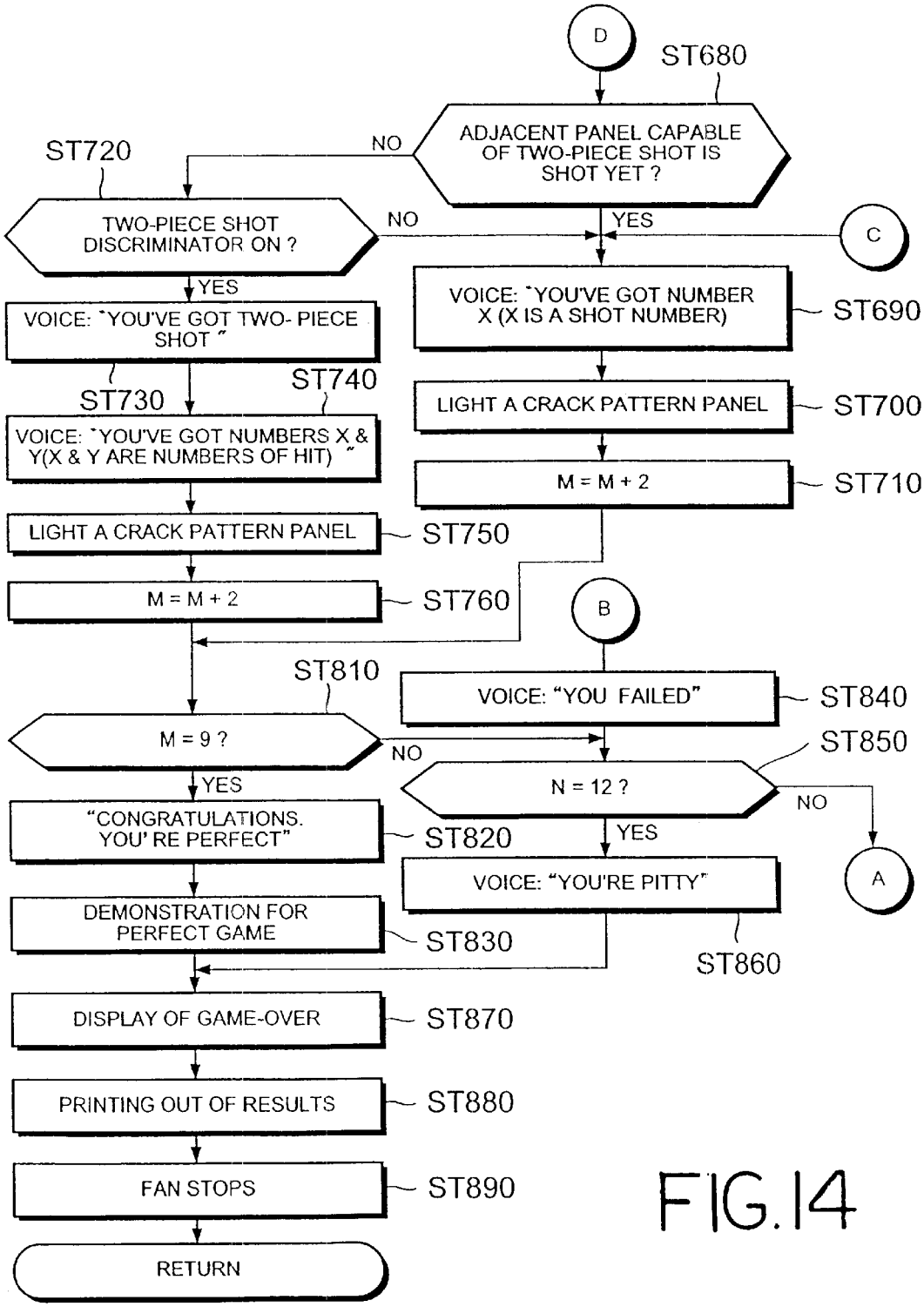
FIG. 14 is a detailed diagram showing the process of the detailed operation of the target hit game device according to the embodiment of the invention.

FIGS. 13 and 14 are diagrams showing the detailed process of the target game of the target hit game device 1. At step ST610, the game control portion 51 assigns the result operation portion 52, the hit discriminator portion 53 and the disc delivery control portion 54 to execute an initial setting, and the result operation portion 52 clears the preceding results, and the disc delivery control portion 54 shifts the number of delivered discs "N" to "0".

Next, the game control portion 51 assigns the fan driving portion 65 to start rotation of the fan 66 (step ST620), and assigns the target display control portion 55 to switch off the LED 1B 325 to LED 9B 325, and witch on the LED 1A 324 to LED 9A 324 to return all the target display to the numerical figure display (step ST630). At step ST640, disc delivery control portion 54 is assigned to deliver a single flying disc.

Figure 15:
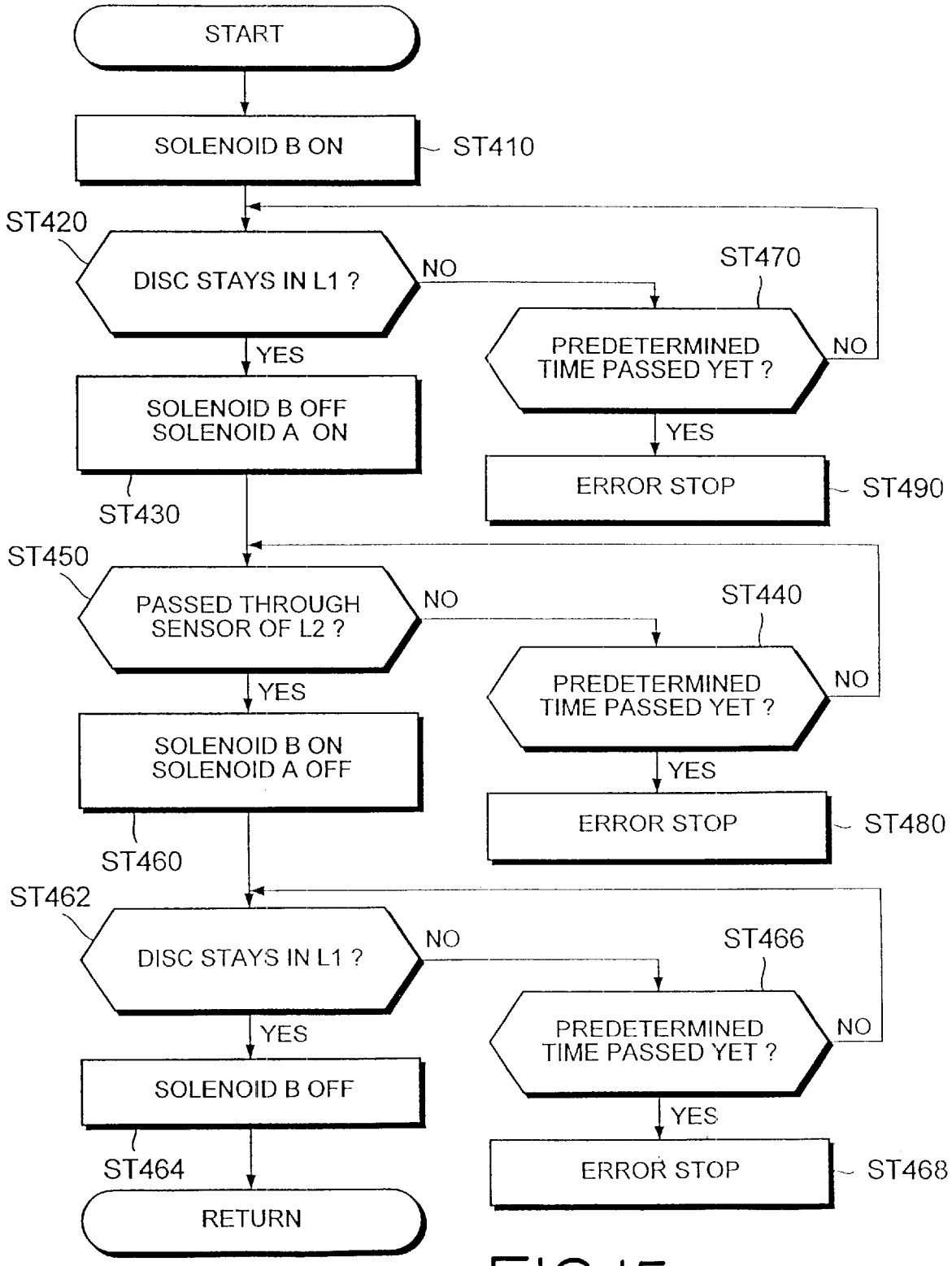
FIG. 15 is a detailed diagram showing the due-out operation of the flying disc.

FIG. 15 is a diagram showing a detailed process of the delivery operation of the flying disc FD. The disc delivery control portion 54 switches ON the solenoid B425 (step ST410), so that a rod B425*a* of the solenoid B425 is moved in and out, the flying disc FD which is engaged with the rod B425*a* of the solenoid B425 is advanced until it advances to be engaged with the rod A424*a* of the solenoid A424 in the forward position, if there is no other flying disc in the forward position. Then the flying disc FD stands by until the delivery sensor B427 detects the flying disc FD staying at the position L1 (step ST420, step ST470). When the flying disc is detected to be positioned at L1 by the delivery sensor B427 the disc delivery control portion 54 switches OFF the solenoid B425, and switches ON the solenoid A424 (step ST430). By this operation, the flying disc staying at the position L1 is delivered toward the flying disc take-out port 413 and, on the other hand, the other flying discs FD staying at the back thereof are engaged by the rod B425*a* of the solenoid B425 to keep stand still.

Then, the disc delivery control portion 54 keeps standing by until the delivered flying disc FD passes the delivery sensor A426 at the position L2 (step ST450, step ST440), and when the flying disc passes the delivery sensor A426 at the position L2, the disc delivery control portion 54 switches ON the solenoid B425 and OFF the solenoid A424 (step ST460). Then the disc delivery control portion 54 stands by until the flying disc FD is detected by the delivery sensor B427 (step ST462, step ST464). When the flying disc FD is detected to be positioned at L1 by the delivery sensor B427, the solenoid B425 is switched OFF by the disc delivery control portion 54 (step ST464), and the process returns to the flow in the diagram of FIG. 13 and stands by until it receives new instructions from game control portion 51.

In case that the flying disc FD is not detected at the position L1 while it is standing at steps ST420 and ST470 for a predetermined time, it can be expected that some accidents have occurred such that the succeeding flying discs FD is prevented from being delivered due to some reasons or that the flying disc is missing by some unknown reasons or any other unexpected accidents have occurred and, in that case, disc delivery control portion 54 serves to consider this case to be an error and transmits an error signal to the game control portion 51 to thereby stop the operation of the game (step ST490).

Similarly, in case that passing of the flying disc FD delivered by the delivery sensor A426, which is positioned at the position L2 for a predetermined time, is not detected at steps ST450 and ST440, the disc delivery control portion 54 takes the situation to be an error and then transmits an error signal to the game control portion 51 to thereby stop the operation of the game (step ST480). Further, in case that the flying disc is not detected at the position L1 after a standing by for the predetermined time at step ST464 by the delivery sensor B427, an error signal is transmitted to the game control portion 51 and stops the process of the game (step ST468).

Returning to FIG. 13, the disc delivery control portion 54 adds the number "1" to the number of the delivered discs, that is, the number "N", so that a new number "N" is stored. This completes preparation for starting the target hit game by a game player.

The player takes out the flying disc FD from the flying disc take-out port 413 and throws it against the target panel 322. When the flying disc FD thrown by the player abuts or shoots the target body 32, the target sensor 326 is made ON ("YES" at step ST660). Then, the hit discriminator portion 53 judges whether the target panel has already been hit or shot (step ST670). If it is not yet hit, the discriminator portion 53 then judges whether the adjacent target panel 322 which is possible for two-piece shot has yet been hit or not (step ST680). If the discrimination is NO, the hit discriminator portion 53 judges whether the two-piece shot discriminator sensor 327 is ON or not (step ST720).

If the judgment is YES, the hit discriminator portion 53 takes that the target panel 322 and the adjacent target panel 322 which is possible for the two-piece shot, wherein the target sensor 327 is ON with respect to these panels 322, are "hit", and the game control portion 51 orders the sound generator portion to generate a voice announcing "You make a two-piece hit." (step ST730), and receives data X and Y of the number of the marked (or hit) target panel from the hit discriminator portion 53 and then transmits the data to the target display control portion 55 and makes the sound generator portion 64 generate a sound "You've got number X and number Y" (step ST740).

In the next step, in order that the crack pattern looms on the X, Y panels, the target display control portion 55 lights the LEDXB and LEDYB to thereby illuminate the second panel member 322*b* of X and Y (step ST750). Then, at step ST760, the result processing portion 52 adds number "2" to the number of "hit" to thereby store the new data of "M" and calculates the scores to display same on the score display portion 62.

In the next step, the result processing portion 52 judges whether the number of hit M reaches "9" (step ST810) and the answer is affirmative (that is, it has reached the number), the game control portion 51 makes the sound generator portion 64 to make a sound announcing "Congratulations! You've got a perfect game!" (step ST820) and assigns the target display control portion 55 and the result (record) processing portion 52 to make a demonstration for the perfect game (step ST830). After that, the result processing portion 52 displays an indication of game-over on the score display portion 262 (step ST870), and proceeds to print out the results (step ST880) and then the game control portion 51 assigns the fan driving portion to stop the operation of the fan 66 (step ST890) to proceed the step to game-over in the game device.

If it is judged that the hit number "M" is not reached the number "9" at step ST810, the process is diverged , and the disc delivery control portion 54 judges whether the number N of the disc delivery reaches "12" (step ST850) and if it reached the state the game control portion 51 makes the sound generator portion 64 announce "What a pity!", and returns to step ST880. Thereafter, the process proceeds to step ST880 and step ST890 for the game-over operation.

When it is judged that the number N of disc delivery does not reach the number 12 at step ST850, the process returns to step ST640 and he disc delivery control portion 54 delivers a single flying disc FD to continue the game.

If the two-piece shot discriminator sensor 327 is not ON at the step ST720, and if the adjacent target panel 322 which is capable of two-piece shot at step ST680 is judged to have been shot at step ST720, the hit discriminator portion 53 judges that only the target panel 322 which the target sensor 326 switched ON is considered hit, and the process is diverged to step ST690, and the game control portion 51 receives data X of the number of the hit or marked target panel 322 from the hit discriminator portion 53, and transmit the data to the target display control portion 55 and makes the sound generator portion 64 to make a sound announcing "You've got the number X" (step ST690).

In order to make the crack pattern to loom on the panel X, the target display control portion 55 lights the LEDX325 to illuminate the second panel member 322*b* (step ST700). Then, the result processing portion 52 adds the number "1" to the hit number M to store the new number M. After that, the process is returned to step ST810 and the result processing portion 52 judges whether the hit number M has reached the number "9" (step ST810).

Returning back to the preceding step, in case that the hit discriminator portion 53 judges the target panel 322 to have been shot or hit already at the step ST670, the process proceeds or diverges to step ST790, and the hit discriminator portion 53 judges whether the two-piece shot discriminator sensor 327 is put ON or not. If it is ON, it is judged whether the adjacent target panel 322 which is capable of two-piece shot has been hit already (step ST795). If it is judged not to have been hit, the hit discriminator portion 53 judges that the adjacent target panel 322 which is capable of two-piece shot is shot (step ST800), and the process goes back to step ST690, and the game control portion 51 receives the data X of the number in the hit target panel 322 from the hit discriminator portion 53. Then the data is transmitted to the target display control portion 55 and the game control portion 51 makes the sound generator portion 64 generate a voice announcing "You've got number X".

When it is judged that the two-piece shot discriminator sensor 327 is not ON at step ST790, and when it is judged that the adjacent target panel capable of two-piece shot has been shot already at step ST795, the process proceeds to step ST840 so that the game control portion 51 makes the sound generator portion 64 generate a voice announcing "You failed," and the process returns to step ST850.

If the target sensor 326 is not ON at step ST660, or during a period until the target sensor 326 is made ON at step ST660, the operational process is diverged to step ST770 so that the game control portion 51 examines whether or not the recovery sensor 63 is made ON (step ST780), and if the recovery sensor 63 is not ON, an examination is made to find whether a predetermined time has passed (step ST780), and if the time has not yet passed, the process returns to step ST660 to examine again whether the target sensor 326 is switched ON. If the target sensor 326 is not yet ON, an examination is made again to find whether the recovery sensor 63 is ON or not, and this operation is repeatedly made until the target sensor 326 is made ON. If the recovery sensor 63 is made ON before the target sensor 326 is ON (YES at step ST770), or if the predetermined time which is assigned per a single flying disc has passed before the target sensor 326 is made ON (YES at step ST780), the process in the flow diagram proceeds to step ST840 and the game control portion 51 makes the sound generator portion 64 generate a voice announcing "You failed," and the game device 1 proceeds an operation for "failure".

Although the invention has been described with reference to a game in which a flying disc is thrown by a hand of an player, the invention is not limited to the embodiment described above but can be applied extensively to the other types of games and embodiments, some examples of which will be described below.

The light-emitting display device, the display switching method, the target hit display method which have been described above will be adaptable to the other game devices attempting to throw balls, spears or javelin (darts) or any other airframes against a target. In addition, this invention can be applied extensively not only to the hand-throwing games but also to the games for kicking the airframes as football game, and games using some tools to make the airframe fly against a target such as a golf game, batting or baseball game, shooting, archery, etc.

Further, the light-emitting display device and the display switching method of the present invention can be used not only as a target but also as a touch-panel which functions to switch the display upon receiving a touch, push, strike or some pressure.

In addition, the light-emitting display device and the display switching apparatus can be applied to the other display devices such as display-changing advertisement panels, display-changing guide panels or any other panels for changing displays, by using, for example, manually operable timers, etc. without depending upon a sensor.

According to the present invention, improved, inexpensive light-emitting display device and display switching apparatus having a mechanical strength can be provided by using no highly integrated circuits. Further, the present invention can provide a compact light-emitting display device and a display switching method which permit reliable display switching operation with less failure, without using a mechanical operational elements.

Further, in the present invention, since the light-emitting display device is used as a target in the game device, it has a high shock resistant and an inexpensive game device can be achieved with a simple structure. Further, in the target hit display method of the present invention, a shot or hit to the airframe can be dramatically displayed with less cost.

What is claimed is:

1. A light-emitting display device comprising:

a forward transparent plate having a light scattering portion for a predetermined pattern relative to a surface direction thereof, a backward transparent plate having a light scattering portion for a pattern relative to a surface direction thereof and disposed at the back of the forward transparent plate in the surface direction of the forward transparent plate, the pattern of the light scattering portion of the backward transparent plate being different from the pattern of the light scattering portion of the forward transparent plate, a light source for the forward transparent plate for supplying incidence of light into the forward transparent plate from an end surface of the forward transparent plate, a light source for the backward transparent plate for supplying incidence of light into the backward transparent plate from an end surface of the backward transparent plate, and switching means for switching emitting/quenching of the light source for the backward transparent plate, wherein at least one of the light incident end surfaces of the forward transparent plate and the light incident end surfaces of the backward transparent plate is positioned in a staggered fashion relative to an adjacent end surface of the other transparent plate.

2. A light-emitting display device according to claim 1, wherein at least one of the light scattering portion of the forward transparent plate and the light scattering portion of the backward transparent plate is formed by applying a coating material on a surface of the transparent plate.

3. A light-emitting display device according to claim 1, wherein a photo-adsorption member is disposed at the back of the backward transparent plate.

4. A light-emitting display device according to claim 1, wherein a translucent plate is provided between the forward transparent plate and the backward transparent plate.

5. A light-emitting display device according to claim 1, wherein the pattern of the light scattering portion of the backward transparent plate is a cracking pattern.

6. A light-emitting display device according to claim 1, wherein a shock sensor is disposed for detecting a shock against the forward transparent plate so that when a shock is detected by the shock sensor, the light source for the backward transparent plate is switched from a quenching state to a emitting state.

7. A light-emitting display device according to claim 6, wherein a plurality of backward transparent plates are provided relative to the forward transparent plate and the switching means is designed to serve to switch the light source for a corresponding backward transparent plate from a quenching state to an emitting state with respect to a shock-impacted portion of the forward transparent plate.

8. A light-emitting display device according to claim 6, wherein a plurality of forward transparent plates are provided and a backward transparent plate is provided corresponding to each of the forward transparent plates and the switching means is designed to serve the light source for the backward transparent plate which corresponds to the forward transparent plate receiving the shock to switch from a quenching state to a emitting state.

9. A light-emitting display device according to claim 6, wherein the shock sensor is disposed at the back of the corresponding forward transparent plate so that a shock transmitted from the forward transparent plate is detected.

10. A light-emitting display device according to claim 8, wherein the object sensor is a shading type sensor so that a portion adjacent to the front surface of the forward transparent plate serves as at least a part of an optical path.

11. A light-emitting display device according to claim 1, wherein the end surface for the incident of light of the forward transparent plate is staggered, inside the backward transparent plate, relative to the end surface adjacent to the corresponding backward transparent plate.

12. A target game apparatus in which a competition is made to hit a target of an airframe by forcing the airframe to fly toward the target plate to evaluate result of the targeted position, comprising a light-emitting display device as the target, wherein the light-emitting display device comprises:

a forward transparent plate having light scattering portion of a predetermined pattern relative to a surface direction thereof, a backward transparent plate having a light scattering portion for a pattern relative to a surface direction thereof and disposed at the back of the forward transparent plate in the surface direction of the forward transparent plate, the pattern of the light scattering portion of the backward transparent plate being different from the pattern of the light scattering portion of the forward transparent plate, a light source for the forward transparent plate for providing incidence of light into the forward transparent plate from an end surface of the forward transparent plate, a light source for the backward transparent plate for providing a light incidence into the backward transparent plate from an end surface for the backward transparent plate, and switching means for switching emitting/quenching of the light source of the backward transparent plate, wherein at least one of the light incident end surfaces of the forward transparent plate and the light incident end surfaces of the backward transparent plate is positioned in a staggered relation relative to an adjacent end surface of the other transparent plate.

13. A target game apparatus according to claim 12, wherein at least one of the light scattering portion of the forward transparent plate and the light scattering portion of the backward transparent plate is formed by applying a coating material on a surface of the transparent plate.

14. A target game apparatus according to claim 12, wherein a photo-adsorption member is disposed at the back of the backward transparent plate.

15. A target game apparatus according to claim 12, wherein a translucent plate is provided between the forward transparent plate and the backward transparent plate.

16. A target game apparatus according to claim 12, wherein the pattern of the light scattering portion of the backward transparent plate is a cracking pattern.

17. A target game apparatus according to claim 12, wherein a shock sensor is provided for detecting a shock against the forward transparent plate so that when a shock is detected by the shock sensor, the light source of the backward transparent plate is switched from a quenching state to a emitting state.

18. A target game apparatus according to claim 17, wherein a plurality of backward transparent plates are provided relative to the forward transparent plate and the switching means is designed to serve to switch the light source of a corresponding backward transparent plate from a quenching state to an emitting state with respect to a shock-impacted portion of the forward transparent plate.

19. A target game apparatus according to claim 17, wherein a plurality of forward transparent plates are provided and a backward transparent plate is provided according to each of the forward transparent plates and the switching means is designed to serve the light source of the backward transparent pate which corresponds to the forward transparent plate receiving the shock to switch from a quenching state to a emitting state.

20. A target game apparatus according to claim 17, wherein the shock sensor is disposed at the back of the corresponding forward transparent plate so that a shock transmitted from the forward transparent plate is detected.

21. A target game apparatus according to claim 17, wherein the object sensor is a shading type sensor so that a portion adjacent to the front surface of the forward transparent plate serves as at least a part of an optical path.

22. A target game apparatus according to claim 12, wherein the end surface for the incident of light of the forward transparent plate is disposed inside the backward transparent plate relative to the adjacent end surface of the corresponding backward transparent plate.

23. A target hit display method in which target hitting of an airframe is displayed intentionally, wherein the method uses:

a forward transparent plate having a light scattering portion for a predetermined pattern relative to a surface direction thereof, a backward transparent plate having a light scattering portion for a pattern relative to a surface direction thereof and disposed at the back of the forward transparent plate in the surface direction of the forward transparent plate, the pattern of the light scattering portion of the backward transparent plate being different from the pattern of the light scattering portion of the forward transparent plate, a light source for the forward transparent plate for supplying incidence of light into the forward transparent plate from an end surface of the forward transparent plate, a light source for the backward transparent plate for supplying incidence of light into the backward transparent plate from an end surface of the backward transparent plate, switching means for switching emitting/quenching of the light source for the backward transparent plate, and an object contact sensor for detecting a contact with the forward transparent plate, wherein when the object contact sensor detects a shock to the forward transparent plate, the switching means switches the light source of the backward transparent plate from a quenching state to an emitting state to thereby permit a intentional display with respect to target hitting of an airframe.

24. A target hit display method in which target hitting of an airframe is displayed intentionally, wherein the method uses:

a forward transparent plate having a plurality of divided regions each having and a light scattering portion of a predetermined pattern relative to a surface direction, a backward transparent plate disposed at the back of the forward transparent plate relative to the surface direction of the forward transparent plate and having a plurality of divided regions divided corresponding to said divided regions of said forward transparent plates and each having a light scattering portion of a pattern which is different from the pattern of the corresponding divided region of the forward transparent plate, a light source for the forward transparent plate for supplying an incident of light to each of the divided regions of the forward transparent plate from an end surface of the forward transparent plate, a plurality of light sources for the backward transparent plate for supplying independently an incident of light to each of the divided regions of the backward transparent plate from an end surface of the backward transparent plate, a switching means for independently switching an emitting state and a quenching state of each of the light sources for the backward transparent plate, and a shading type sensor using a portion adjacent to a boarder of the predetermined regions along the front surface of the forward transparent plate as at least a part of a light path, wherein when the shading type sensor is shaded, the light source for the backward transparent plate corresponding to opposite regions adjacent to the corresponding boarder is switched from a quenching state to an emitting state to thereby intentionally display target hitting of an airframe to both regions.

25. A light-emitting display device comprising:

a forward transparent plate having a light scattering portion for a predetermined pattern relative to a surface direction thereof, a backward transparent plate having a light scattering portion for a pattern relative to a surface direction thereof and disposed at the back of the forward transparent plate in the surface direction of the forward transparent plate, the pattern of the light scattering portion of the backward transparent plate being different from the pattern of the light scattering portion of the forward transparent plate, a light source for the forward transparent plate for supplying incidence of light into the forward transparent plate from an end surface of the forward transparent plate, a light source for the backward transparent plate for supplying incidence of light into the backward transparent plate from an end surface of the backward transparent plate, switching means for switching emitting/quenching of the light source for the backward transparent plate, and wherein a contact sensor is further provided for detecting a contact of an object to a front surface of the forward transparent plate so that switching of emitting/quenching of the light source for the backward transparent plate is controlled in response to an output of the contact sensor.

26. A light-emitting display device according to claim 25, wherein at least one of the light scattering portion of the forward transparent plate and the light scattering portion of the backward transparent plate is formed by applying a coating material on a surface of the transparent plate.

27. A light-emitting display device according to claim 25, wherein a photo-adsorption member is disposed at the back of the backward transparent plate.

28. A light-emitting display device according to claim 25, wherein a translucent plate is provided between the forward transparent plate and the backward transparent plate.

29. A light-emitting display device according to claim 25, wherein the pattern of the light scattering portion of the backward transparent plate is a cracking pattern.

30. A light-emitting display device according to claim 25, wherein a shock sensor is disposed for detecting a shock against the forward transparent plate so that when a shock is detected by the shock sensor, the light source for the backward transparent plate is switched from a quenching state to a emitting state.

31. A light-emitting display device according to claim 30, wherein a plurality of backward transparent plates are provided relative to the forward transparent plate and the switching means is designed to serve to switch the light source for a corresponding backward transparent plate from a quenching state to an emitting state with respect to a shock-impacted portion of the forward transparent plate.

32. A light-emitting display device according to claim 30, wherein a plurality of forward transparent plates are provided and a backward transparent plate is provided corresponding to each of the forward transparent plates and the switching means is designed to serve the light source for the backward transparent plate which corresponds to the forward transparent plate receiving the shock to switch from a quenching state to a emitting state.

33. A light-emitting display device according to claim 30, wherein the shock sensor is disposed at the back of the corresponding forward transparent plate so that a shock transmitted from the forward transparent plate is detected.

34. A light-emitting display device according to claim 25, wherein the object sensor is a shading type sensor so that a portion adjacent to the front surface of the forward transparent plate serves as at least a part of an optical path.

35. A light-emitting display device according to claim 25, wherein at least one of the light incident end surfaces of the forward transparent plate and the light incident end surfaces of the backward transparent plate is positioned in a staggered fashion relative to an adjacent end surface of the other transparent plate.

36. A light-emitting display device according to claim 25, wherein the end surface for the incident of light of the forward transparent plate is staggered, inside the backward transparent plate, relative to the end surface adjacent to the corresponding backward transparent plate.

37. A target game apparatus in which a competition is made to hit a target of an airframe by forcing the airframe to fly toward the target plate to evaluate result of the targeted position, comprising a light-emitting display device as the target, wherein the light-emitting display device comprises:

a forward transparent plate having light scattering portion of a predetermined pattern relative to a surface direction thereof, a backward transparent plate having a light scattering portion for a pattern relative to a surface direction thereof and disposed at the back of the forward transparent plate in the surface direction of the forward transparent plate, the pattern of the light scattering portion of the backward transparent plate being different from the pattern of the light scattering portion of the forward transparent plate, a light source for the forward transparent plate for providing incidence of light into the forward transparent plate from an end surface of the forward transparent plate, a light source for the backward transparent plate for providing a light incidence into the backward transparent plate from an end surface for the backward transparent plate, switching means for switching emitting/quenching of the light source of the backward transparent plate, and wherein a contact sensor is further provided for detecting a contact of an object to a front surface of the forward transparent plate so that switching of emitting/quenching of the light source for backward transparent plate is controlled in response to an output of the contact sensor.

38. A target game apparatus according to claim 37, wherein at least one of the light scattering portion of the forward transparent plate and the light scattering portion of the backward transparent plate is formed by applying a coating material on a surface of the transparent plate.

39. A target game apparatus according to claim 37, herein a photo-adsorption member is disposed at the back of the backward transparent plate.

40. A target game apparatus according to claim 37, wherein a translucent plate is provided between the forward transparent plate and the backward transparent plate.

41. A target game apparatus according to claim 37, wherein the pattern of the light scattering portion of the backward transparent plate is a cracking pattern.

42. A target game apparatus according to claim 37, wherein a shock sensor is provided for detecting a shock against the forward transparent plate so that when a shock is detected by the shock sensor, the light source of the backward transparent plate is switched from a quenching state to a emitting state.

43. A target game apparatus according to claim 42, wherein a plurality of backward transparent plates are provided relative to the forward transparent plate and the switching means is designed to serve to switch the light source of a corresponding backward transparent plate from a quenching state to an emitting state with respect to a shock-impacted portion of the forward transparent plate.

44. A target game apparatus according to claim 42, wherein a plurality of forward transparent plates are provided and a backward transparent plate is provided according to each of the forward transparent plates and the switching means is designed to serve the light source of the backward transparent plate which corresponds to the forward transparent plate receiving the shock to switch from quenching state to a emitting state.

45. A target game apparatus according to claim 42, wherein the shock sensor is disposed at the back of the corresponding forward transparent plate so that a shock transmitted from the forward transparent plate is detected.

46. A target game apparatus according to claim 37, wherein the object sensor is a shading type sensor so that a portion adjacent to the front surface of the forward transparent plate serves as at least a part of an optical path.

47. A target game apparatus according to claim 37, wherein at least one of the light incident end surfaces of the forward transparent plate and the light incident end surfaces of the backward transparent plate is positioned in a staggered relation relative to an adjacent end surface of the other transparent plate.

48. A target game apparatus according to claim 37, wherein the end surface for the incident of light of the forward transparent plate is disposed inside the backward transparent plate relative to the adjacent end surface of the corresponding backward transparent plate.

* * * * *

UNITED STATES PATENT AND TRADEMARK OFFICE

CERTIFICATE OF CORRECTION

PATENT NO. : 6,462,720 B1
DATED : October 8, 2002
INVENTOR(S) : Akihisa Yamashita et al.

It is certified that error appears in the above-identified patent and that said Letters Patent is hereby corrected as shown below:

Column 20,
Line 8, “8” should be changed to -- 1 --.

Column 21,
Lines 16 and 20, “17” should be changed to -- 19 --.

Column 23,
Line 40, “25” should be changed to -- 35 --.

Column 24,
Line 15, “herein” should be changed to -- wherein --.
Line 61, “37” should be changed to -- 47 --.

Signed and Sealed this

Fifteenth Day of July, 2003

JAMES E. ROGAN
*Director of the United States Patent and Trademark Office*